US006474775B1

(12) United States Patent
Okamoto

(10) Patent No.: US 6,474,775 B1
(45) Date of Patent: Nov. 5, 2002

(54) INK JET RECORDING APPARATUS AND METHOD FOR RECORDING WITH PLURAL NOZZLE ARRAYS

(75) Inventor: Akira Okamoto, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/511,372

(22) Filed: Feb. 23, 2000

(30) Foreign Application Priority Data

Feb. 26, 1999 (JP) ..... 11-050596
Dec. 13, 1999 (JP) ..... 11-353057

(51) Int. Cl.[7] ..... B41J 2/01
(52) U.S. Cl. ..... 347/37; 347/12; 347/43
(58) Field of Search ..... 347/12, 15, 37, 347/41, 43

(56) References Cited

U.S. PATENT DOCUMENTS 4,313,124 A 1/1982 Hara
4,345,262 A 8/1982 Shirato et al.
4,459,600 A 7/1984 Sato et al.
4,463,359 A 7/1984 Ayata et al.
4,558,333 A 12/1985 Sugitani et al.
4,608,577 A 8/1986 Hori
4,723,129 A 2/1988 Endo et al.
4,740,796 A 4/1988 Endo et al.
6,039,434 A * 3/2000 Moroney ..... 347/43
6,209,987 B1 * 4/2001 Katayama ..... 347/43

FOREIGN PATENT DOCUMENTS

JP 54-56847 5/1979
JP 59-123670 7/1984
JP 59-138461 8/1984
JP 60-71260 4/1985

* cited by examiner

*Primary Examiner*—Craig A. Hallacher
(74) *Attorney, Agent, or Firm*—Fitzpatrick, Cella, Harper & Scinto

(57) ABSTRACT

In an area to be recorded with a black ink and a color ink superposed, when an area recorded by the same main-scanning and an area recorded by the other main-scanning mixedly exist, band unevenness occurs. It is an object of the present invention to suppress the band unevenness without reducing a recording speed. Therefore, upon certain main-scanning, it is determined whether image data to be recorded with a cyan ink exists in an area C in FIG. 2 or not. When it is determined that the image data exists, recording by a discharging orifice array for black is not performed in the area C in the main-scanning. When it is determined that no image data exists, recording for the area C is performed in the main-scanning by the discharging orifice array for black.

13 Claims, 29 Drawing Sheets

○ — PRINT DATA EXISTS

× — NO PRINT DATA EXISTS

INK JET RECORDING APPARATUS AND METHOD FOR RECORDING WITH PLURAL NOZZLE ARRAYS

BACKGROUND OF THE INVENTION

1. Field of the Invention

The present invention relates to an ink jet recording apparatus and method and, more particularly, to an ink jet recording apparatus and method to prevent the occurrence of band unevenness and deterioration of a recording speed, caused by a color image and a black image mixedly existing in a recorded area.

2. Related Background Art

An ink jet recording method has been broadly used for printers and copying machines because of the realization of a low noise, a low running cost, a small size and ease of color printing of a recorded image.

In an apparatus utilizing such an ink jet recording method, four color inks—black, yellow, cyan, and magenta—are generally used for color image recording. In addition, there has been put into practical use an apparatus capable of recording a high-quality color image having a less conspicuous granular appearance by using inks of light-black, light-yellow, light-cyan, and light-magenta—obtained by reducing the ink densities of the above four colors—in addition to the four colors.

In such color ink jet recording apparatuses, in order to realize both a high processing speed upon printing black characters and low cost of the recording apparatus, there has been proposed a method wherein the number of discharging orifices in the black ink recording head is greater than that of the other color ink recording heads. Providing many discharging orifices in the black ink recording head realizes the high-speed recording of black characters. As the length of the head increases, the cost rises. Decreasing the number of discharging orifices in the color ink recording heads reduces the length of each head, so that the costs of heads decrease. Consequently, a lower cost of the whole recording apparatus is realized. Generally, in a serial printer, the discharging orifice array of the black ink recording head and the discharging orifice arrays of the color ink recording heads are arranged in parallel so as to be parallel with the direction perpendicular to a main-scanning direction for recording.

In an ink jet recording apparatus comprising heads with a different number of discharging orifices for each color, an area to be recorded with a black ink and a color ink superposed, and an area to be recorded in one main-scanning and an area to be recorded in the other main-scanning may mixedly exist. This occurs by using the heads with the different number of discharging orifices for colors. Furthermore, an area which can be recorded with the black ink but cannot be recorded with the color ink appears in one main-scanning at the time of the main-scanning of the head.

Ordinarily, in the case of recording with two color inks superposed, the color tone changes depending on the difference between the recording timings of two color inks. It is estimated as follows. When comparing the case where the following ink droplet reaches the recording medium before the preceding ink droplet has penetrated enough into the recording medium with the case where the following ink droplet reaches the recording medium after the preceding ink droplet has penetrated enough into the recording medium, the rate of penetration of the preceding ink droplet into the recording medium in the former case is different from that in the latter case. The difference between the penetration rates results in a difference between the tones in portions where two color inks have been superposed. As mentioned above, when the area recorded with two color inks is superposed or combined in the same main-scanning and the area recorded with two color inks superposed in the other main-scanning mixedly exist, so-called lateral-striped band unevenness occurs. Hitherto, in the above-mentioned ink jet recording apparatus, it is a problem that band unevenness occurs.

Hitherto, in order to avoid the problem, there has been proposed a method of recording in such a manner that a high picture quality recording mode is performed. In the recording mode, not all of the discharging orifices of the black ink recording head are used, but only the discharging orifices of the black ink recording head which correspond to an area capable of being recorded by the color ink recording heads in the same main-scanning are used to record. In other words, it is a method wherein the number of discharging orifices of the color ink recording heads to be used is equal to that of the black ink recording head and the number of discharging orifices for black is set so as to be equal to that of the color ink recording heads.

However, in the conventional high picture quality recording mode, when any color image exists in a recording area, not all of the discharging orifices of the black ink recording head are used even when black images occupy most of the recording area. Consequently, when a predetermined recording area for the black images alone is recorded, it is a problem that recording speed is remarkably deteriorated.

SUMMARY OF THE INVENTION

The present invention is made in consideration of the above problems. According to the present invention, it is an object to provide an ink jet recording apparatus and method wherein upon recording using heads with different numbers of discharging orifices for colors, even when a color image and a black image mixedly exist in a recording area, the occurrence of band unevenness is suppressed without deteriorating a recording speed.

In order to accomplish the above object, a recording apparatus according to the present invention is characterized by comprising as follows.

That is, there is provided an ink jet recording apparatus for recording an image on a recording medium, wherein a first discharging orifice array arranging a plurality of discharging orifices for discharging a first ink and a second discharging orifice array arranging a plurality of discharging orifices for discharging a second ink are disposed in parallel in a main-scanning direction different from the arranging direction, and the first discharging orifice array, second discharging orifice array, and recording medium are relatively moved in the arranging direction of the discharging orifices for each main-scanning of the first and second discharging orifice arrays in the main-scanning direction, and wherein when it is assumed in one main-scanning that an area where a main-scanning area of the first discharging orifice array does not overlap with a main-scanning area of the second discharging orifice array is set to a first area and an overlapping area is set to a second area, in the case where image data to be recorded by the second discharging orifice array exists in the first area, recording for the first area by the first discharging orifice array is not performed, and in the case where no image data to be recorded by the second discharging orifice array exists in the first area, recording for the first area is performed by the first discharging orifice array.

A recording method according to the present invention is characterized by comprising as follows.

That is, there is provided an ink jet recording method of recording an image on a recording medium in such a manner that a first discharging orifice array arranging a plurality of discharging orifices for discharging a first ink and a second discharging orifice array arranging a plurality of discharging orifices for discharging a second ink are disposed in parallel in a main-scanning direction different from the arranging direction, and the first discharging orifice array, second discharging orifice array, and recording medium are relatively moved in the arranging direction of the discharging orifices for each main-scanning of the first and second discharging orifice arrays in the main-scanning direction, wherein when it is assumed in one main-scanning that an area where a main-scanning area of the first discharging orifice array does not overlap with a main-scanning area of the second discharging orifice array is set to a first area and an overlapping area is set to a second area, in the case where recording by the first discharging orifice array and recording by the second discharging orifice array are performed in the first area, the recording by the first discharging orifice array and the recording by the second discharging orifice array are performed in the same main-scanning.

A computer readable storage medium according to the invention is characterized by comprising as follows.

There is provided a computer readable storage medium which has stored a program code to execute a recording control process of an ink jet recording apparatus for recording an image on a recording medium in such a manner that a first discharging orifice array arranging a plurality of discharging orifices for discharging a first ink and a second discharging orifice array arranging a plurality of discharging orifices for discharging a second ink are disposed in parallel in a main-scanning direction different from the arranging direction, and the first discharging orifice array, second discharging orifice array, and recording medium are relatively moved in the arranging direction of the discharging orifices for each main-scanning of the first discharging orifice array and second discharging orifice array in the main-scanning direction, wherein the program code includes control processing codes to control the ink jet recording apparatus in such a manner that when it is assumed in one main-scanning that an area where a main-scanning area of the first discharging orifice array does not overlap with a main-scanning area of the second discharging orifice array is set to a first area and an overlapping area is set to a second area, in the case where image data to be recorded by the first discharging orifice array and image data to be recorded by the second discharging orifice array exist in the first area, recording for the first area by the first discharging orifice array is not performed in the main-scanning, and in the case where image data alone to be recorded by the first discharging orifice array exists in the first area and no image data to be recorded by the second discharging orifice array exists, recording for the first area is performed in the main-scanning by the first discharging orifice array.

DETAILED DESCRIPTION OF THE PREFERRED EMBODIMENTS (First Embodiment)

Figure 1:
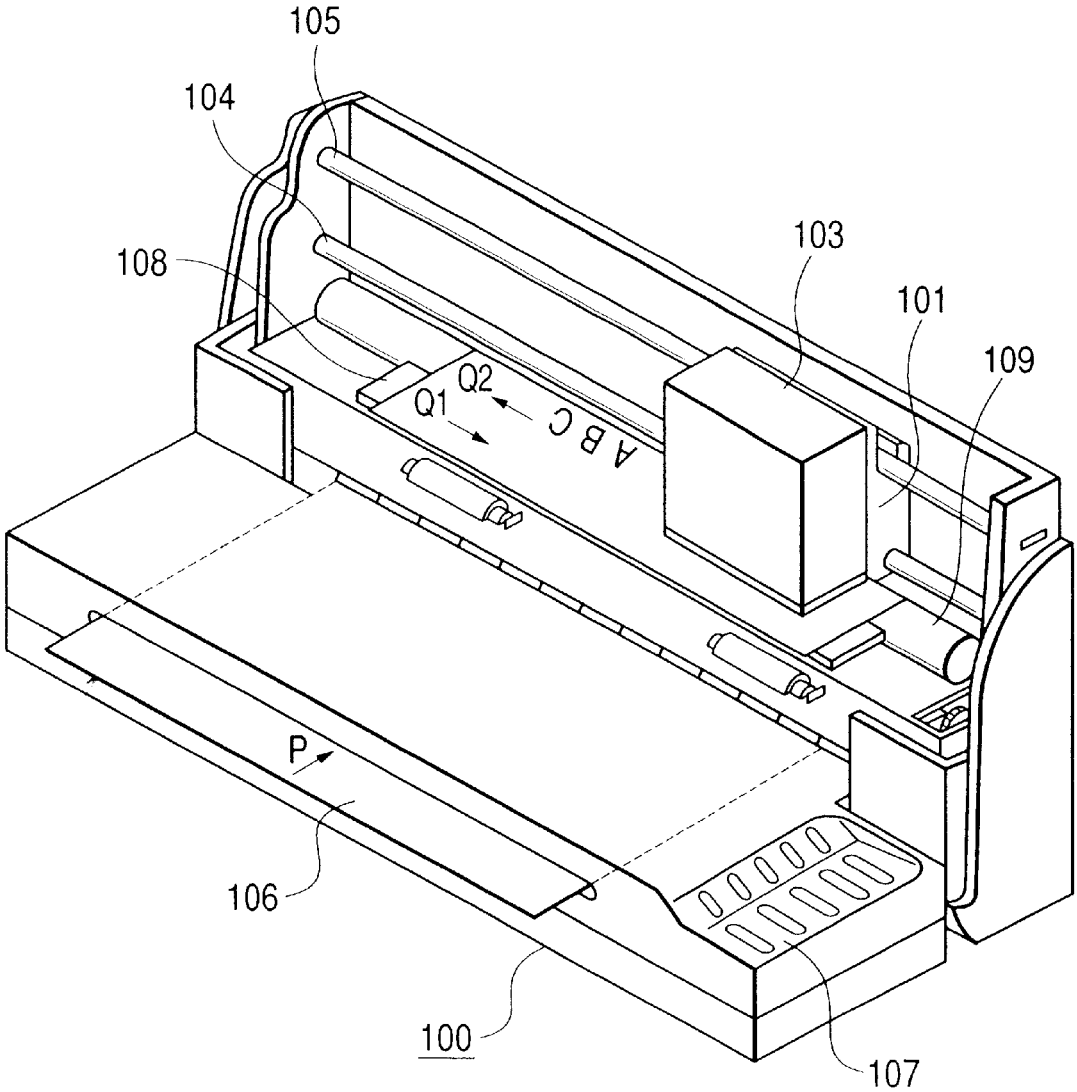
FIG. 1 is a perspective view of a recording apparatus to which the present invention can be applied.

FIG. 1 is a perspective view of an ink jet recording apparatus to which the present invention can be applied. A recording medium 106 inserted into a paper feeding position of a recording apparatus 100 is sent in the direction shown by an arrow P by a feed roller 109 and is conveyed to a recordable area of a recording head. A platen 108 is provided under the recording medium 106 in the recordable area. A carriage 101 is axially movable by two guide shafts 104 and 105 and scans a recording area reciprocatingly in the directions shown by arrows Q1 and Q2. A cartridge 103 which can be mounted on the carriage 101 comprises a recording head which can eject a plurality of color inks and ink tanks containing inks to be supplied to the recording head. As a plurality of color inks in the ink jet recording apparatus in the embodiment, four color inks such as black ink (hereinbelow, also referred to as "Bk"), cyan ink (hereinbelow, also referred to as "C"), magenta ink (hereinbelow, also referred to as "M"), and yellow ink (hereinbelow, also referred to as "Y") are used.

An arrangement unit 107 comprises a switching unit and a display device unit. The switching unit is used when a power source for the recording apparatus is turned on or off or various recording modes are set. The display device unit displays a state of the recording apparatus.

Figure 2:
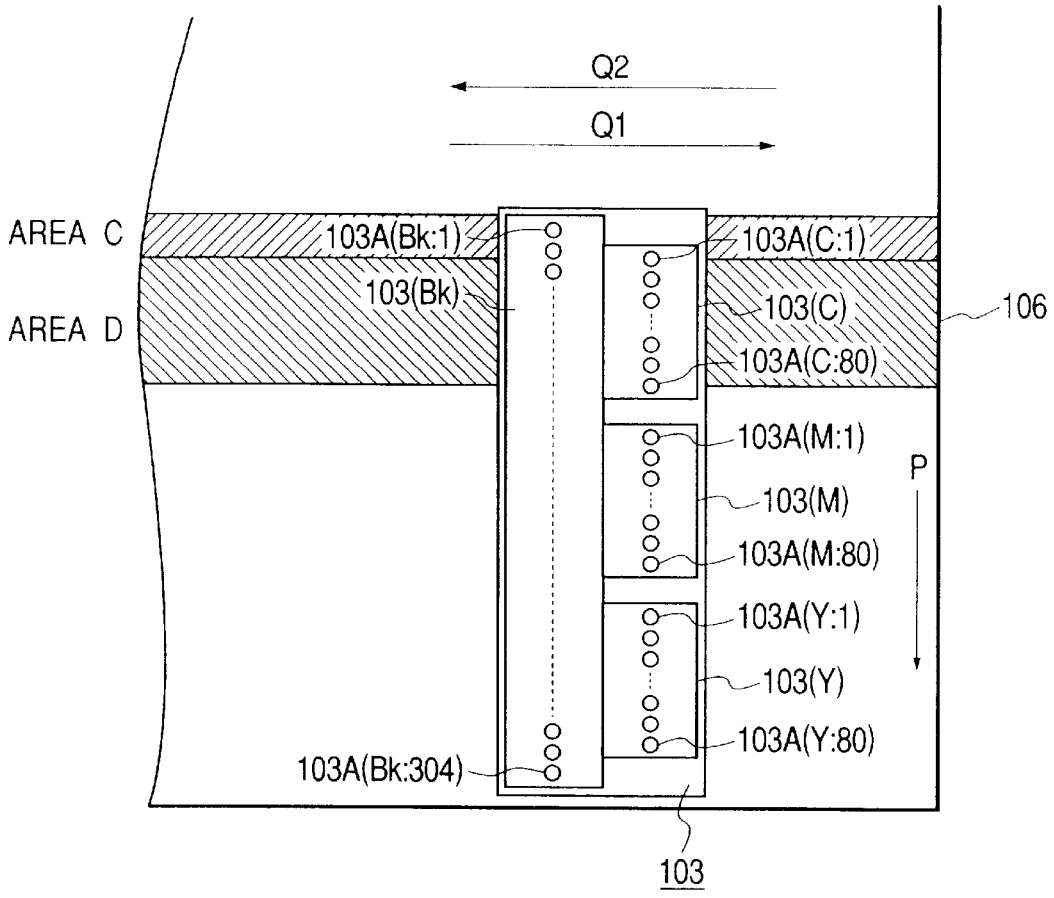
FIG. 2 is an explanatory diagram of arrangement of discharging orifices of recording heads in a first embodiment of the present invention.

FIG. 2 shows an arrangement of discharging nozzles 103A in the recording head and is a schematic diagram of the cartridge 103 as viewed from the upper side of the recording medium 106. Recording heads 103(Y), 103(M), 103(C), and 103(Bk) eject inks of yellow, magenta, cyan, and black, respectively. The cartridge 103 moves on the recording medium 106 in the main-scanning direction shown by the arrows Q1 and Q2. The recording medium 106 is conveyed in a sub-scanning direction shown by the arrow P for the cartridge 103. In the present embodiment, the number of discharging orifices 103A of the recording head 103(Bk) for black is set to 304. The number of discharging orifices 103A of each of the recording heads 103(Y), 103(M), and 103(C) for the other colors is set to 80. Each pitch between the discharging orifices 103A is set to about 42 $\mu$m.

The distance (distance in the main-scanning direction shown by the arrows Q1 and Q2) between the discharging orifices 103A in the recording head 103(Bk) and the discharging orifices 103A in the recording heads 103(C), 103(M), and 103(Y) is set to a value that is 360 times as large as the pitch between the discharging orifices 103A. The discharging orifices 103A of the recording heads 103(Y), 103(M), 103(C), and 103(Bk) are arranged straight in the direction substantially perpendicular to the main-scanning direction, respectively.

In this instance, in order to simplify the expression, in the present specification, the discharging orifices 103A which are located at the nth positions from the upper ends of the recording heads 103(Y), 103(M), 103(C), and 103(Bk) are referred to as 103A(Y:n), 103A(M:n), 103A(C:n), and 103A (Bk:n), respectively.

The explanation will be continuously made with the above expressions. The discharging orifices 103A(C:1), 103A(M:1), and 103A(Y:1) correspond to the discharging orifices 103A(Bk:17), 103A(Bk:113), and 103A(Bk:209) in the main-scanning direction of the cartridge 103 and they are arranged so as to be adjacent to each other in the main-scanning direction. Each of the recording heads 103(Y), 103(M), 103(C), and 103(Bk) is a head for ejecting the ink by using heat energy. The head has an electrothermal converting element to generate heat energy. The heat energy generated by the electrothermal converting element produces film boiling in ink. A change in pressure generated due to the growth and contraction of a bubble produced by the film boiling is used to eject the ink from the discharging orifices 103A.

As for the above recording heads, the form in which each head is separately provided every color is used. The recording head is not limited to the above form but it can have any form.

Figure 3:
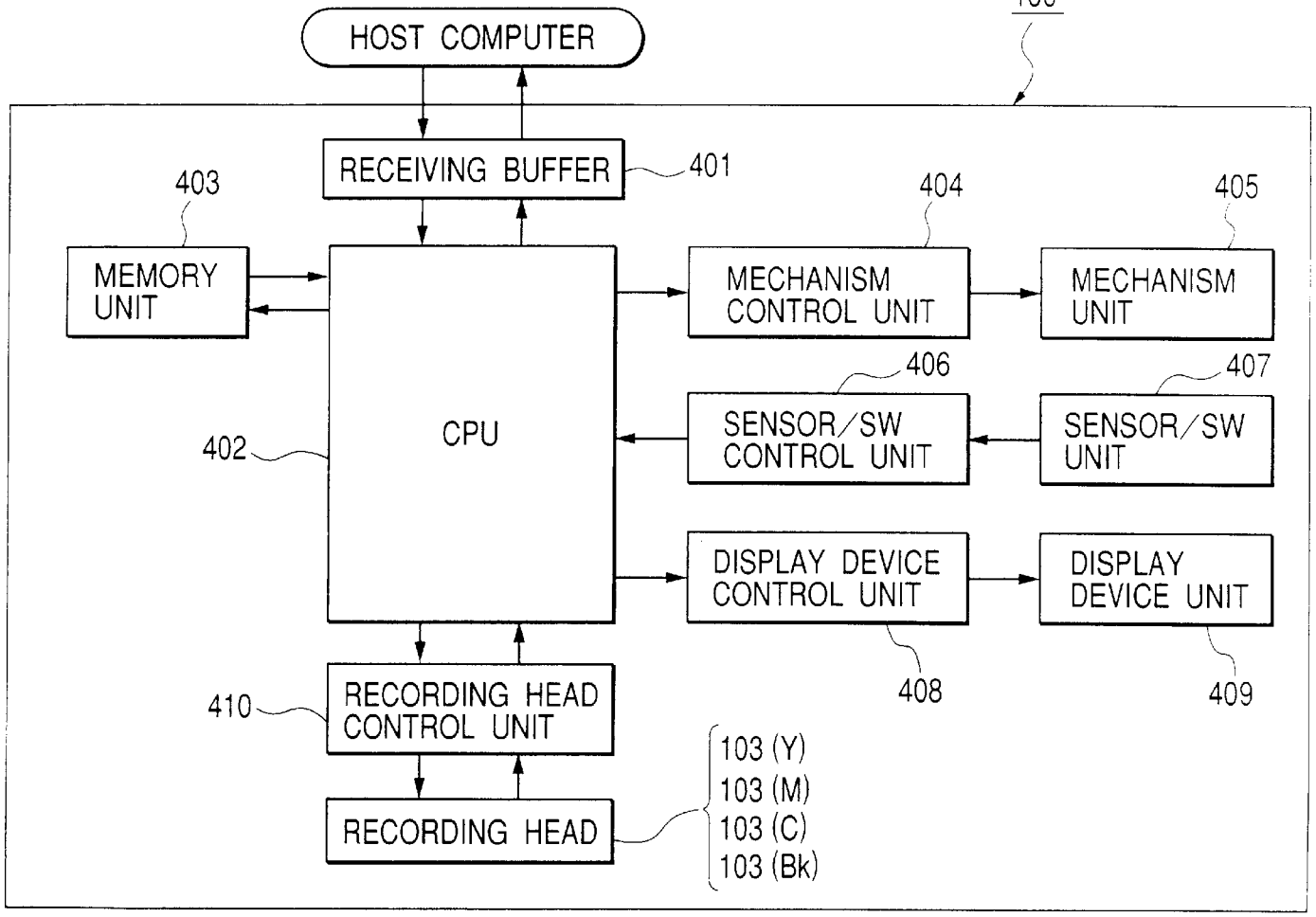
FIG. 3 is a block constructional diagram of a control system of a recording apparatus to which the present invention can be applied.

FIG. 3 is a block diagram of an ink jet recording apparatus to which the present invention can be applied. Data of characters or images to be recorded is inputted from a host computer to a receiving buffer 401 of the recording apparatus 100. Data to confirm whether the data is correctly transferred and data to inform the operating state of the recording apparatus 100 are transmitted from the recording apparatus 100 to the host computer. The data in the receiving buffer 401 is transferred to a memory unit 403 under the management of a CPU 402 and is temporarily stored in an RAM (random access memory) of the memory unit 403. A mechanism control unit 404 controls a mechanism unit 405 such as carriage motor or line feed motor in accordance with an instruction from the CPU 402. A sensor/SW control unit 406 transmits a signal from a sensor/SW unit 407 comprising various sensors and switches (SWs) to the CPU 402. A display device control unit 408 controls a display device unit 409 comprising LEDs or liquid crystal elements of a display panel group on the basis of an instruction from the CPU 402. A recording head control unit 410 controls the recording heads 103(Y), 103(M), 103(C), and 103(Bk) on the basis of an instruction from the CPU 402. The recording head control unit 410 detects temperature information and the like indicative of the state of the recording head and sends them to the CPU 402.

Figure 4:
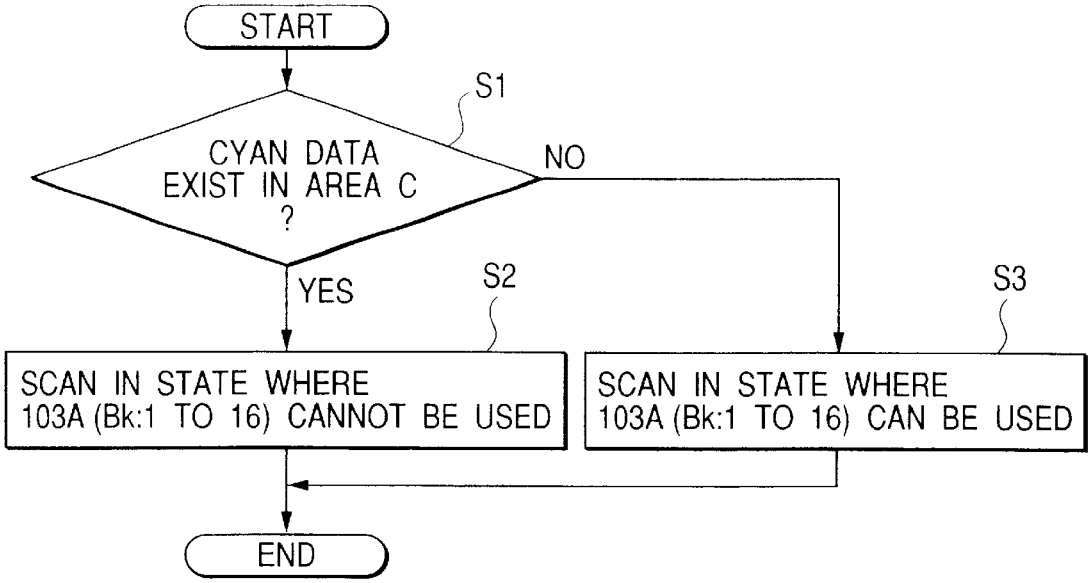
FIG. 4 is a flowchart showing a recording operation in the first embodiment of the present invention.

FIG. 4 is a flowchart for explaining the recording operation. The description will be made with respect to the case of recording data corresponding to one page in a one-pass (referred to as 1-pass) forward direction recording mode. The 1-pass forward direction recording mode is a recording operation in which while the carriage 101 is reciprocatingly moved in the main-scanning direction, the data is recorded only upon movement in the forward path, the recording is not performed upon movement in the backward path, and a recording area of one line is completed in one main-scanning in the direction shown by the arrow Q2.

Hereinbelow, it is assumed that a recording area D is set as an area where both of the black ink and the cyan ink can be simultaneously recorded in the same main-scanning and a recording area C is set as an area which is located in the rear of the recording area D in the moving direction of the recording medium and which can be recorded with the black ink in the same main-scanning but cannot be recorded with the cyan ink. More precisely, the recording area D is the area which can be recorded by the discharging orifices 103A (Bk:17 to 96) and 103A(C: 1 to 80) shown in FIG. 2 and the recording area C is the area which can be recorded by the discharging orifices 103A(Bk: 1 to 16).

Referring to FIG. 4, the explanation will now be made. First, in step S1, whether image data to be recorded with the cyan ink exists in the recording area C or not is determined. The CPU 402 shown in FIG. 3 makes the determination.

When it is determined that data to be recorded with the cyan ink exists in the recording area C, the processing routine advances to step S2. The recording operation is performed in a state where the discharging orifices 103A (Bk: 1 to 16) cannot be used in the main-scanning. On the other hand, when it is determined that no data to be recorded with the cyan ink exists in the recording area C, step S3 follows. The recording operation is performed in a state where the discharging orifices 103A(Bk: 1 to 16) can be used in the main-scanning.

Figure 5:
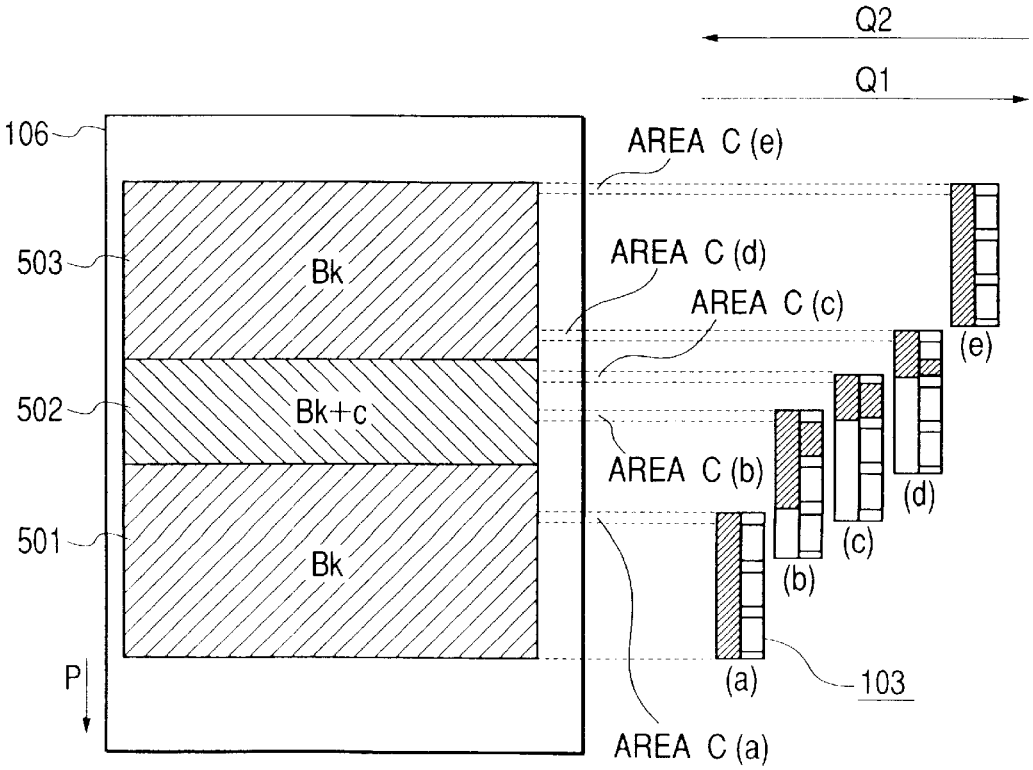
FIG. 5 is an explanatory diagram of the recording operation in the first embodiment of the present invention.

FIG. 5 is a diagram for explaining the recording operation based on the algorithm of the present embodiment. Each of recording areas 501 and 503 in FIG. 5 is an area to be recorded with the black ink alone and a recording area 502 is an area to be recorded with the black ink and the cyan ink as superposed or combined.

The recording medium 106 inserted to a paper feeding position of the recording apparatus 100 is conveyed in the direction shown by the arrow P by the feed roller 109. When the relative position of the medium for the cartridge 103 reaches a printing start position (a), a first main-scanning is started in accordance with the algorithm of FIG. 4. In step S1, it is determined whether image data to be recorded with the cyan ink exists in an area C(a) or not.

Consequently, since it is determined that it does not exist, step S3 follows. The recording operation is performed in such a state where the discharging orifices 103A(Bk: 1 to 16) can be used and the discharging orifices in a hatched portion in the diagram are used. When the first main-scanning is finished, the recording medium 106 is conveyed again in the direction shown by the arrow P by the feed roller 109.

When the relative position of the medium for the cartridge 103 reaches a print starting position (b), a second main-scanning is started in accordance with the algorithm of FIG. 4. In step S1, it is determined whether image data to be recorded with the cyan ink exists in an area C(b) or not. Consequently, since it is determined that the data exists, step S2 follows. The recording operation is performed in a state where the discharging orifices 103A(Bk: 1 to 16) cannot be used and the discharging orifices in a hatched portion in the diagram are used. When the second main-scanning is finished, the recording medium 106 is again conveyed in the direction shown by the arrow P by the feed roller 109.

The relative position of the medium for the cartridge 103 reaches a print starting position (c), a third main-scanning is started in accordance with the algorithm of the FIG. 4. In step S1, it is determined whether image data to be recorded with the cyan ink exists in an area C(c) or not. Consequently, since it is determined that the data exists, step S2 follows. The recording operation is performed in a state where the discharging orifices 103A(Bk: 1 to 16) cannot be used and the discharging orifices in a hatched portion in the diagram are used. When the third main-scanning is finished, the recording medium 106 is again conveyed in the direction shown by the arrow P by the feed roller 109.

When the relative position of the medium for the cartridge 103 reaches a print starting position (d), a fourth main-scanning is started in accordance with the algorithm of FIG. 4. In step S1, it is determined whether image data to be recorded with the cyan ink exists in an area C(d) or not. Consequently, since it is determined that no data exists, step S3 follows. The recording operation is performed in a state where the discharging orifices 103A(Bk: 1 to 16) can be used and the discharging orifices in a hatched portion in the diagram are used. When the fourth main-scanning is finished, the recording medium 106 is again conveyed in the direction shown by the arrow P by the feed roller 109.

The relative position of the medium for the cartridge 103 reaches a print starting position (e), a fifth main-scanning is started in accordance with the algorithm of the FIG. 4. In step S1, it is determined whether image data to be recorded with the cyan ink exists in an area C(e) or not. Consequently, since it is determined that no data exists, step S3 follows. The recording operation is performed in a state where the discharging orifices 103A(Bk: 1 to 16) can be used and the discharging orifices in a hatched portion in the diagram are used. When the entire recording operation is completed, the recording medium 106 is ejected and the process is finished.

The above recording operation is executed under the control of the CPU for controlling the whole of the ink jet recording apparatus. More specifically, the CPU 402 reads out a control program to execute the above recording process, which has been stored in the memory unit 403, to execute the above control.

As mentioned above, in the present embodiment, since the area to be recorded with two color inks such as black ink and color ink superposed is always recorded in the same main-scanning, the occurrence of band unevenness can be suppressed. As mentioned above, since the number of discharging orifices to be used is determined in accordance with image data, the recording operation can be made without reducing a recording speed.

The above recording head is not limited to a system for ejecting ink by using electrothermal converting elements. For example, a discharging head of a piezo system may be used to eject liquid in such a manner that supplying a current to piezo-electric elements vibrates the piezo-electric elements. Another system that may be used is an electrostatic system in which liquid is ejected due to an electrostatic force. The electrostatic system has been used in ink jet recording apparatuses.

(Second Embodiment)

In the above-described first embodiment, the embodiment of the present invention has been described by using the construction of the recording head shown in FIG. 2. The construction of the recording head is not limited to it but a construction shown in, for instance, FIG. 6 can be used.

Figure 6:
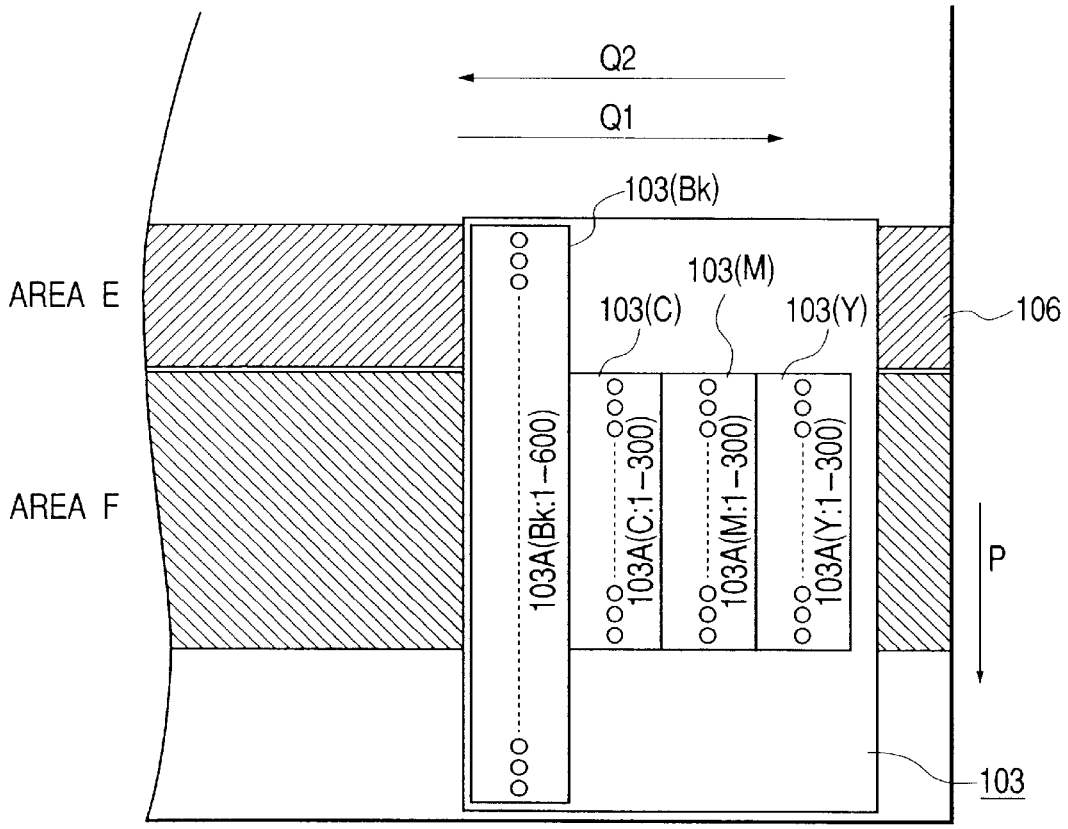
FIG. 6 is an explanatory diagram of arrangement of discharging orifices of recording heads in a second embodiment of the present invention.

FIG. 6 shows an arrangement of the discharging nozzles 103A of the cartridge 103 in the second embodiment and is a schematic diagram of the cartridge 103 as viewed from the upper side of the recording medium 106. The recording heads 103(Y), 103(M), 103(C), and 103(Bk) eject inks of yellow, magenta, cyan, and black, respectively. The cartridge 103 moves on the recording medium 106 in the main-scanning direction shown by the arrows Q1 and Q2. The recording medium 106 is conveyed in the sub-scanning direction shown by the arrow P for the cartridge 103. The number of discharging orifices 103A of the recording head 103(Bk) for the black ink is set to 600. The number of discharging orifices 103A of each of the recording heads 103(Y), 103(M), and 103(C) for the other color inks is set to 300. Each pitch between the discharging orifices 103A is set to about 42 $\mu$m.

The distance (distance in the main-scanning direction shown by the arrows Q1 and Q2) between the adjacent discharging orifices 103A in the recording heads 103(Y), 103(M), 103(C), and 103(Bk) is set to a value that is 100 times as large as the pitch between the discharging orifices 103A. The discharging orifices 103A of the recording heads 103(Y), 103(M), 103(C), and 103(Bk) are arranged straight in the direction substantially perpendicular to the main-scanning, respectively. The discharging orifices 103A(Y:1), 103A(M:1), 103A(C:1), and 103A(Bk:151) are arranged serially in the main-scanning direction so as to correspond to each other in the main-scanning direction of the cartridge 103. Each of the recording heads 103(Y) to 103(Bk) is a head for ejecting ink by using heat energy. The head has an electrothermal converting element to generate heat energy. The heat energy generated by the electrothermal converting element causes film boiling in ink. A change in pressure generated due to the growth and contraction of a bubble produced by the film boiling is used to eject the ink from the discharging orifices 103A.

Figure 7:
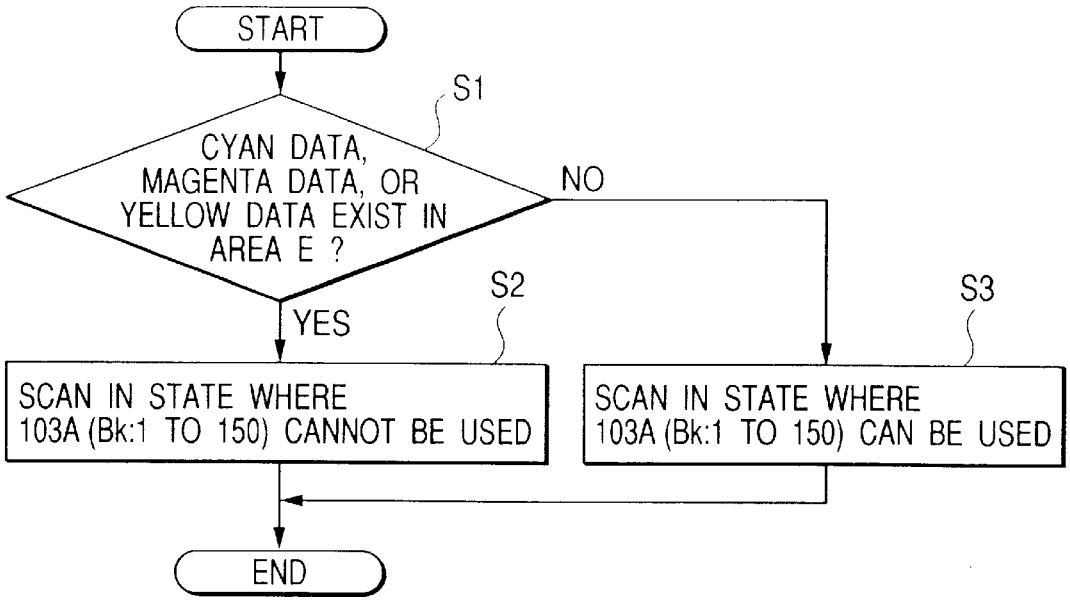
FIG. 7 is a flowchart showing a recording operation in the second embodiment of the present invention.

FIG. 7 is a flowchart for explaining the recording operation. The description will be made with respect to the case of recording data corresponding to one page in the 1-pass forward direction recording mode. The 1-pass forward direction recording mode has been described in the first embodiment.

Hereinbelow, it is assumed that a recording area F is set as an area which can be recorded by simultaneously using the black ink, cyan ink, magenta ink, and yellow ink in the same main-scanning. A recording area E is set as an area which is located in the rear of the recording area F in the moving direction of the recording medium and which can be recorded with the black ink in the same main-scanning, but cannot be recorded with the cyan ink, magenta ink, or yellow ink.

More precisely, the recording area F denotes an area which can be recorded by using the discharging orifices 103A(Bk: 151 to 450) and all of the discharging orifices of the heads 103(C), 103(M), and 103(Y) as shown in FIG. 6 and the recording area E denotes an area which can be recorded by using the discharging orifices 103A(Bk: 1 to 150).

Referring to FIG. 7, the explanation will now be made. First in step S1, it is determined whether image data to be recorded with the cyan ink, magenta ink, or yellow ink exists in the recording area E or not. The CPU 402 shown in FIG. 3 makes the determination.

When it is determined that data to be recorded with the cyan ink, magenta ink, or yellow ink exists in the recording area E, step S2 follows. In the main-scanning, the recording operation is performed in a state where the discharging orifices 103A(Bk: 1 to 150) cannot be used. When it is determined that data to be recorded with the cyan ink, magenta ink, or yellow ink does not exist in the recording area E, step S3 follows. The recording operation is performed in a state where the discharging orifices 103A(Bk: 1 to 150) can be used in the main-scanning.

Figure 8:
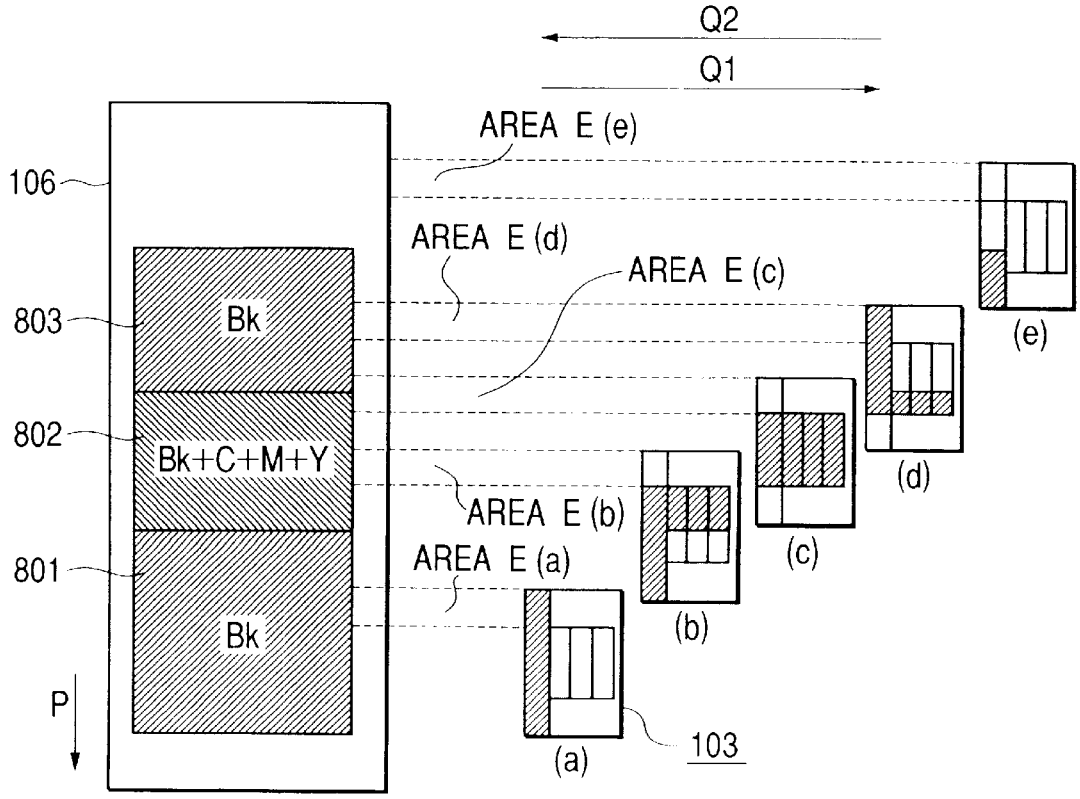
FIG. 8 is an explanatory diagram of the recording operation in the second embodiment of the present invention.

FIG. 8 is a diagram for explaining the recording operation based on the algorithm of the present embodiment. Each of recording areas 801 and 803 in FIG. 8 is an area to be recorded with the black ink alone and a recording area 802 is an area to be recorded with the black ink and the cyan ink, magenta ink, or yellow ink as superposed or combined.

The recording medium 106 inserted to a paper feeding position of the recording apparatus 100 is conveyed in the direction shown by the arrow P by the feed roller 109. When the relative position of the medium for the cartridge 103 reaches the print starting position (a), a first main-scanning is started in accordance with the algorithm of FIG. 7. In step S1, it is determined whether image data to be recorded with the cyan ink, magenta ink, or yellow ink exists in an area E(a) or not.

Consequently, since it is determined that it does not exist, step S3 follows. The recording operation is performed in such a state where the discharging orifices 103A(Bk: 1 to 150) can be used by using the discharging orifices in a gray portion in the diagram. When the first main-scanning is finished, the recording medium 106 is conveyed again in the direction shown by the arrow P by the feed roller 109.

When the relative position of the medium for the cartridge 103 reaches the print starting position (b), a second main-scanning is started in accordance with the algorithm of FIG. 7. In step S1, it is determined whether image data to be recorded with the cyan ink, magenta ink, or yellow ink exists in an area E(b) or not. Consequently, since it is determined that the data exists, step S2 follows. The recording operation is performed in a state where the discharging orifices 103A (Bk: 1 to 150) cannot be used and the discharging orifices in a gray portion in the diagram are used. When the second main-scanning is finished, the recording medium 106 is again conveyed in the direction shown by the arrow P by the feed roller 109.

The relative position of the medium for the cartridge 103 reaches the print starting position (c), a third main-scanning is started in accordance with the algorithm of the FIG. 7. In step S1, it is determined whether image data to be recorded with the cyan ink, magenta ink, or yellow ink exists in an area E(c) or not. Consequently, since it is determined that the data exists, step S2 follows. The recording operation is performed in a state where the discharging orifices 103A (Bk: 1 to 150) cannot be used and the discharging orifices in a gray portion in the diagram are used. When the third main-scanning is finished, the recording medium 106 is again conveyed in the direction shown by the arrow P by the feed roller 109.

When the relative position of the medium for the cartridge 103 reaches the print starting position (d), a fourth main-scanning is started in accordance with the algorithm of FIG. 7. In step S1, it is determined whether image data to be recorded with the cyan ink, magenta ink, or yellow ink exists in an area E(d) or not. Consequently, since it is determined that no data exists, step S3 follows. The recording operation is performed in a state where the discharging orifices 103A (Bk: 1 to 150) can be used and the discharging orifices in a gray portion in the diagram are used. When the fourth main-scanning is finished, the recording medium 106 is again conveyed in the direction shown by the arrow P by the feed roller 109.

The relative position of the medium for the cartridge 103 reaches the print starting position (e), a fifth main-scanning is started in accordance with the algorithm of the FIG. 7. In step S1, it is determined whether image data to be recorded with the cyan ink, magenta ink, or yellow ink exists in an area E(e) or not. Consequently, since it is determined that no data exists, step S3 follows. The recording is performed in a state where the discharging orifices 103A(Bk: 1 to 150) can be used and the discharging orifices in a gray portion in the diagram are used. When the entire recording operation is completed, the recording medium 106 is ejected and the process is finished.

The above recording operation is executed under the control of the CPU for controlling the whole of the ink jet recording apparatus. More specifically, the CPU 402 reads out a control program to execute the above recording process, which has been stored in the memory unit 403, to execute the above control.

As mentioned above, in the present embodiment, since the recording heads for black, cyan, yellow, and magenta are arranged in parallel in the main-scanning direction to perform the above recording operation, the area in which at least two colors of black ink and the other color inks are superposed can be always recorded in the same main-scanning, so that the occurrence of band unevenness is suppressed or combined and color images can be recorded without deteriorating a recording speed.

(Third Embodiment)

The description has been narrowed down to the operation upon main-scanning in the first and second embodiments. In the present embodiment, explanation will be made with respect to the whole operation including a sub-scanning as well.

Figure 12:
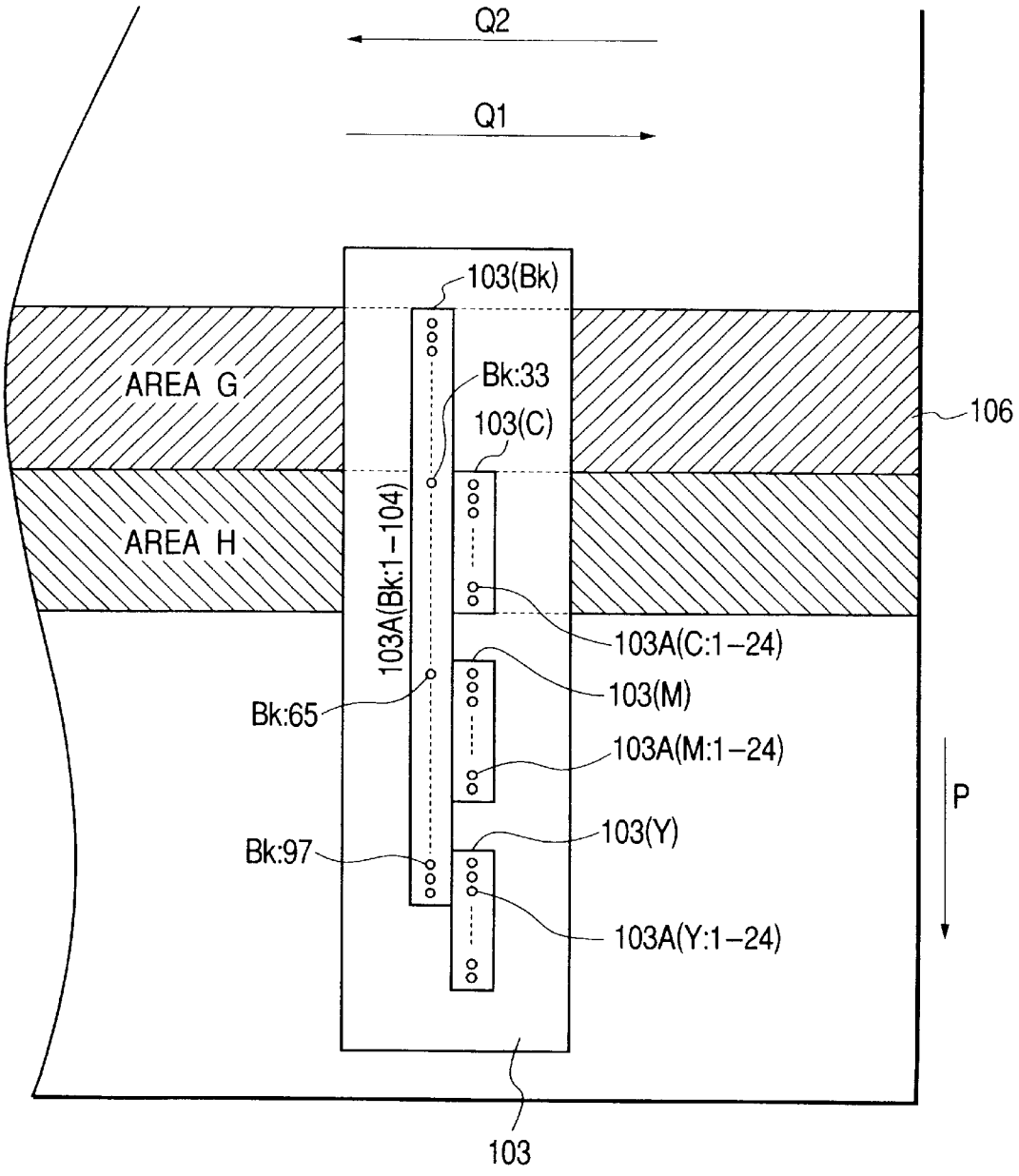
FIG. 12 is an explanatory diagram of arrangement of discharging orifices of recording heads in a third embodiment of the present invention.

FIG. 12 shows an arrangement of the discharging nozzles 103A of the cartridge 103 in the third embodiment and is a schematic diagram of the cartridge 103 as viewed from the upper side of the recording medium 106. The recording heads 103(Y), 103(M), 103(C), and 103(Bk) eject inks of yellow, magenta, cyan, and black, respectively. The cartridge 103 moves on the recording medium 106 in the main-scanning direction shown by the arrows Q1 and Q2. The recording medium 106 is conveyed in the sub-scanning direction shown by the arrow P for the cartridge 103. The number of discharging orifices 103A of the recording head 103(Bk) for black ink is set to 104. The number of discharging orifices 103A of each of the recording heads 103(Y), 103(M), and 103(C) for the other color inks is set to 24. Each pitch between the discharging orifices 103A is set to about 42 $\mu$m.

The distance (distance in the main-scanning direction shown by the arrows Q1 and Q2) between the discharging orifices 103A in the recording head 103(Bk) and the discharging orifices 103A in the recording heads 103(C), 103(M), and 103(Y) is set to a value that is 16 times as large as the pitch between the discharging orifices 103A. The discharging orifices 103A of the recording heads 103(C), 103(M), 103(Y), and 103(Bk) are arranged straight in the direction substantially perpendicular to the main-scanning direction.

The discharging orifices 103A(C:1), 103A(M:1), and 103A(Y:1) correspond to the discharging orifices 103A (Bk:33), 103A(Bk:65), and 103A(Bk:97) in the main-scanning direction of the cartridge 103 and they are arranged so as to be adjacent to each other in the main-scanning direction. Each of the recording heads 103(Y) to 103(Bk) is the head for ejecting ink by using heat energy. The head has an electrothermal converting element to generate heat energy. The heat energy generated by the electrothermal converting element produces film boiling in ink. A change in pressure generated due to the growth and contraction of a bubble produced by the film boiling is used to eject the ink from the discharging orifices 103A.

Figure 13:
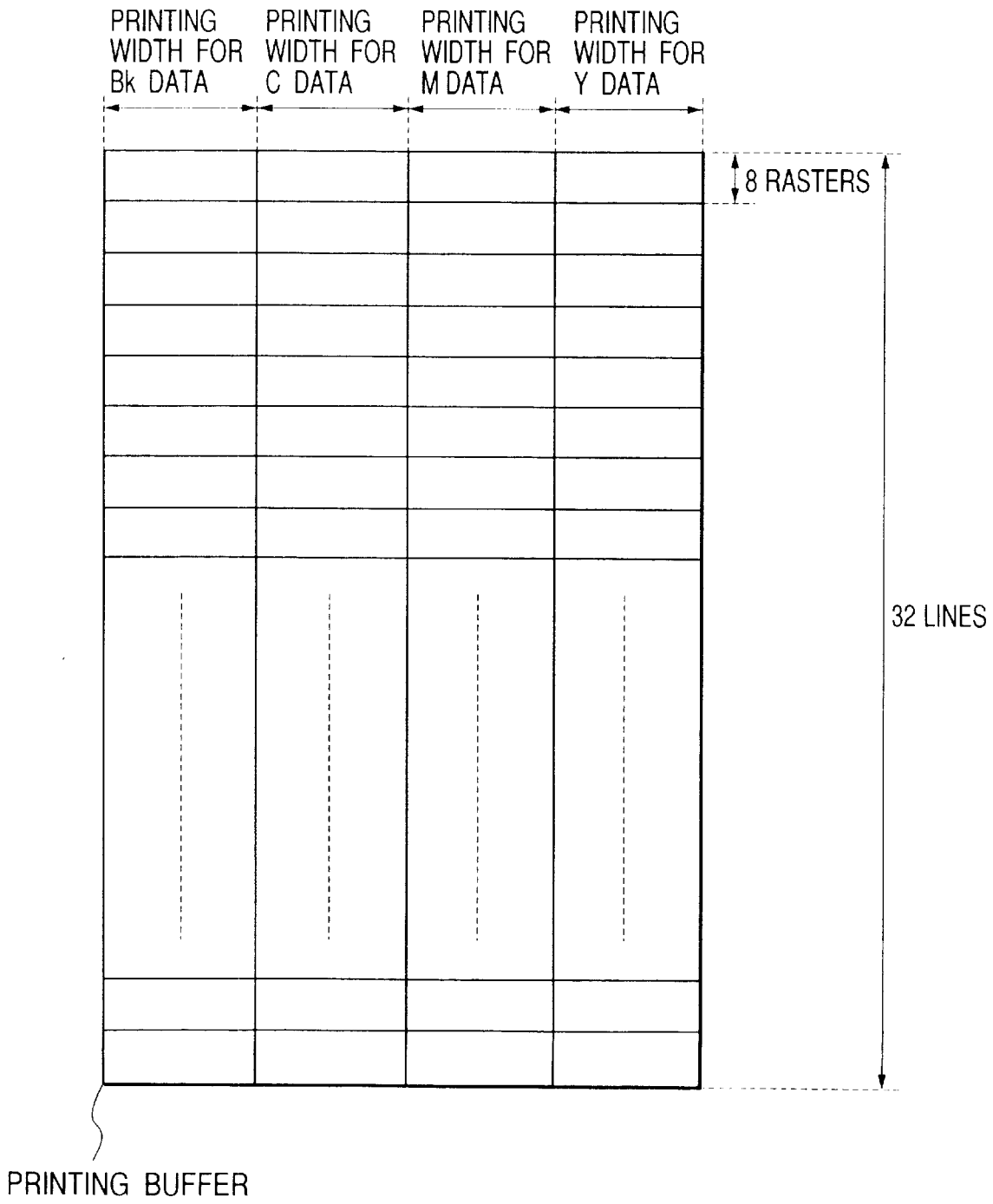
FIG. 13 is a diagram showing a construction of a printing buffer which is used in the third embodiment.

FIG. 13 is a diagram showing a construction of a printing buffer which is used in the present embodiment. The printing buffer indicates a storage area in which data to be printed is temporarily stored and is constructed in the memory unit 403 in FIG. 3. In the present embodiment as shown in FIG. 13, the printing buffer is managed on the basis of a predetermined unit (print width×eight rasters). 32 buffers are prepared for each color. The buffers are used in accordance with the order from the first one. After the 32nd buffer is used, the buffers are reused in accordance with the order from the first one.

Figure 14:
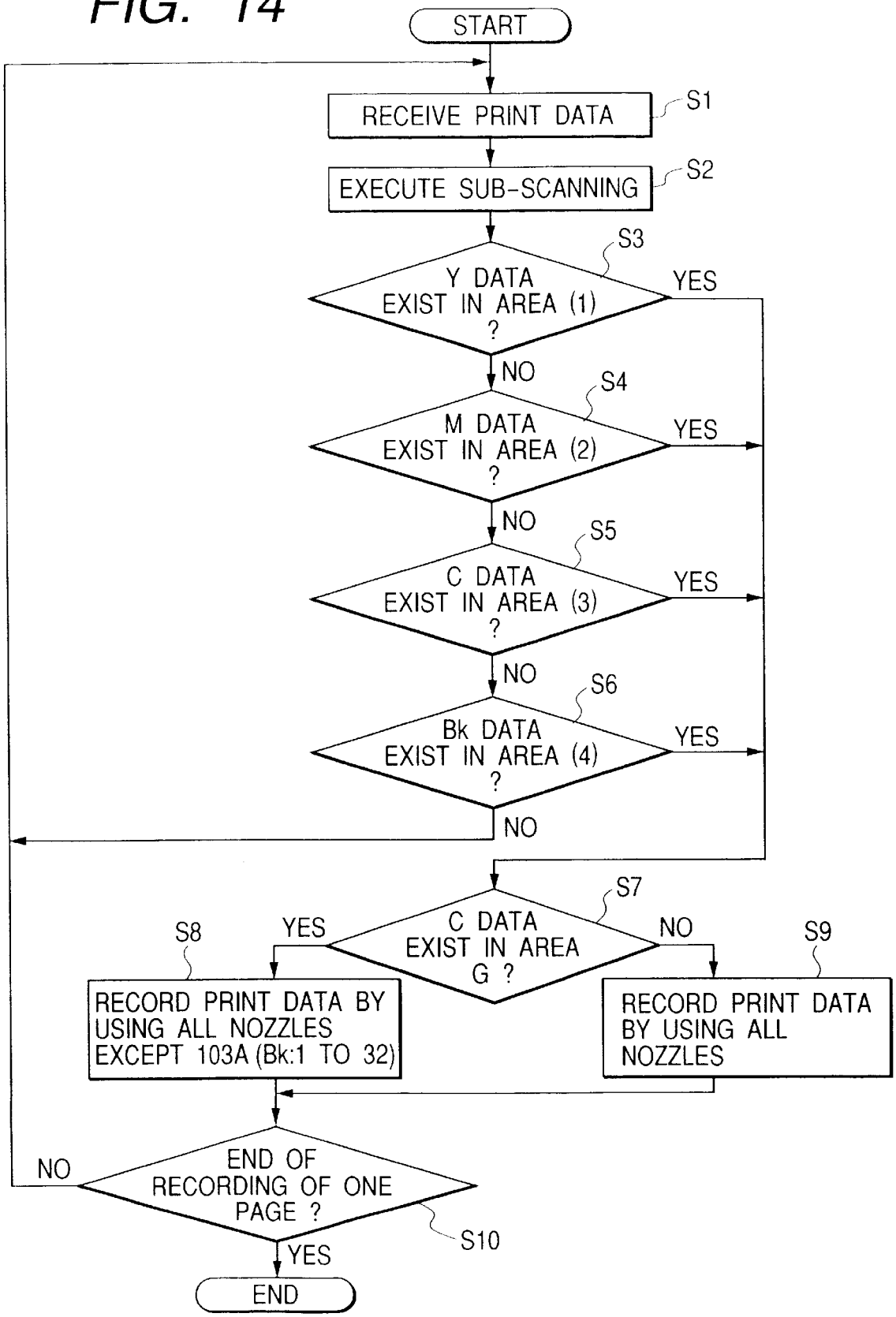
FIG. 14 is a flowchart for explaining a recording operation in the third embodiment of the present invention.
Figure 15:
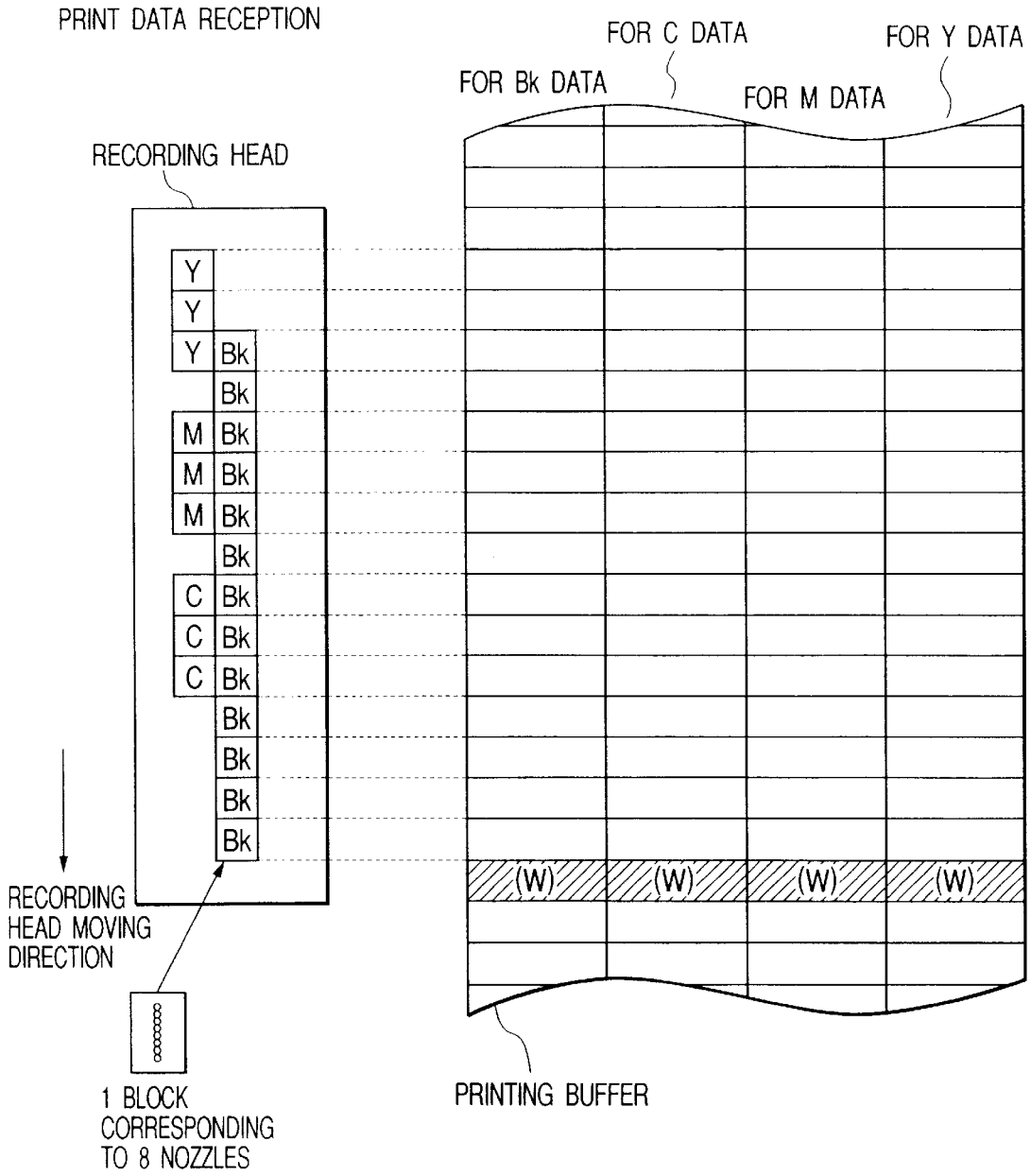
FIG. 15 is a diagram showing how the recording head performs the recording operation.
Figure 16:
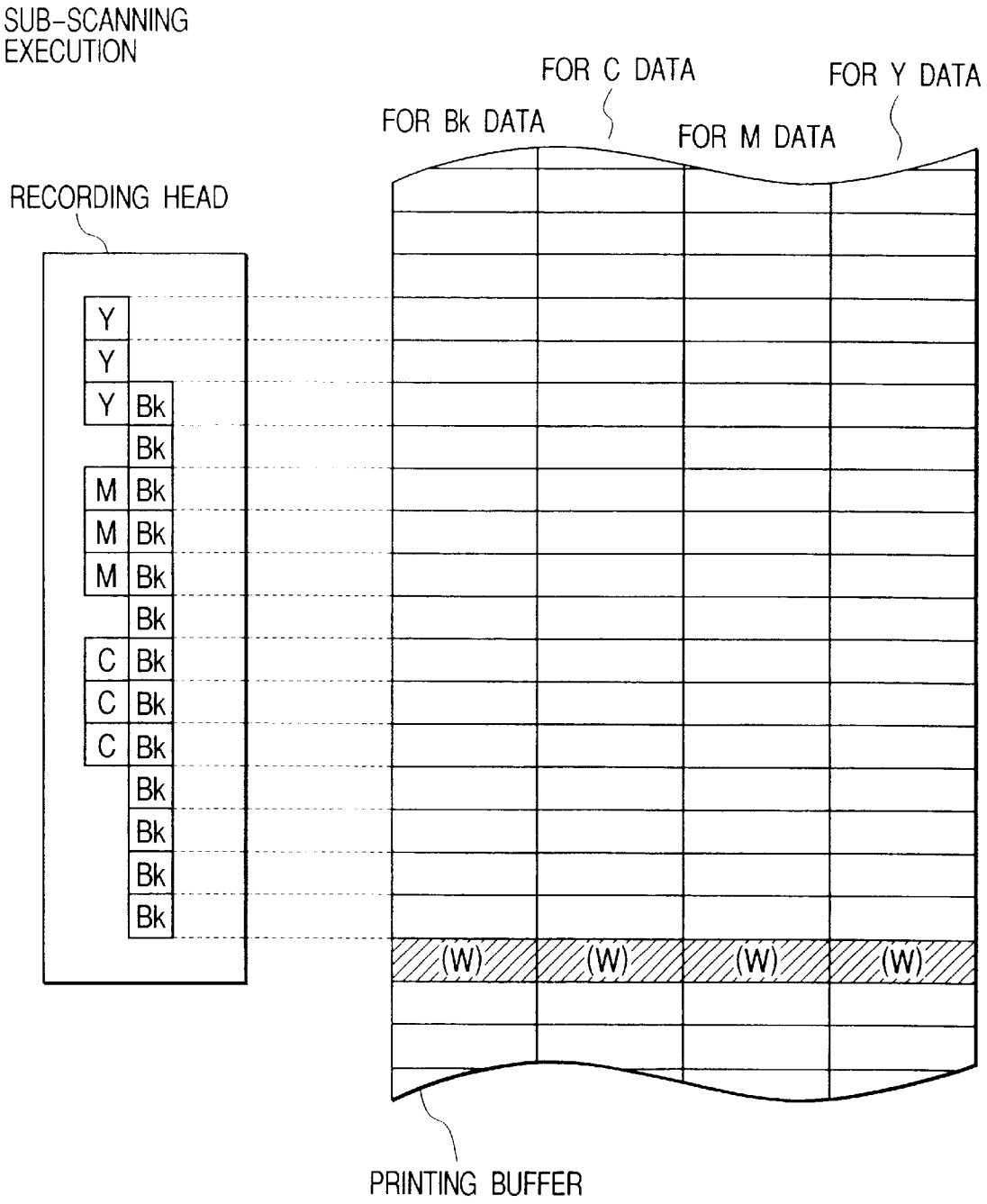
FIG. 16 is a diagram showing the operation of the recording head and determination of print data when the flowchart of FIG. 14 is executed.
Figure 17:
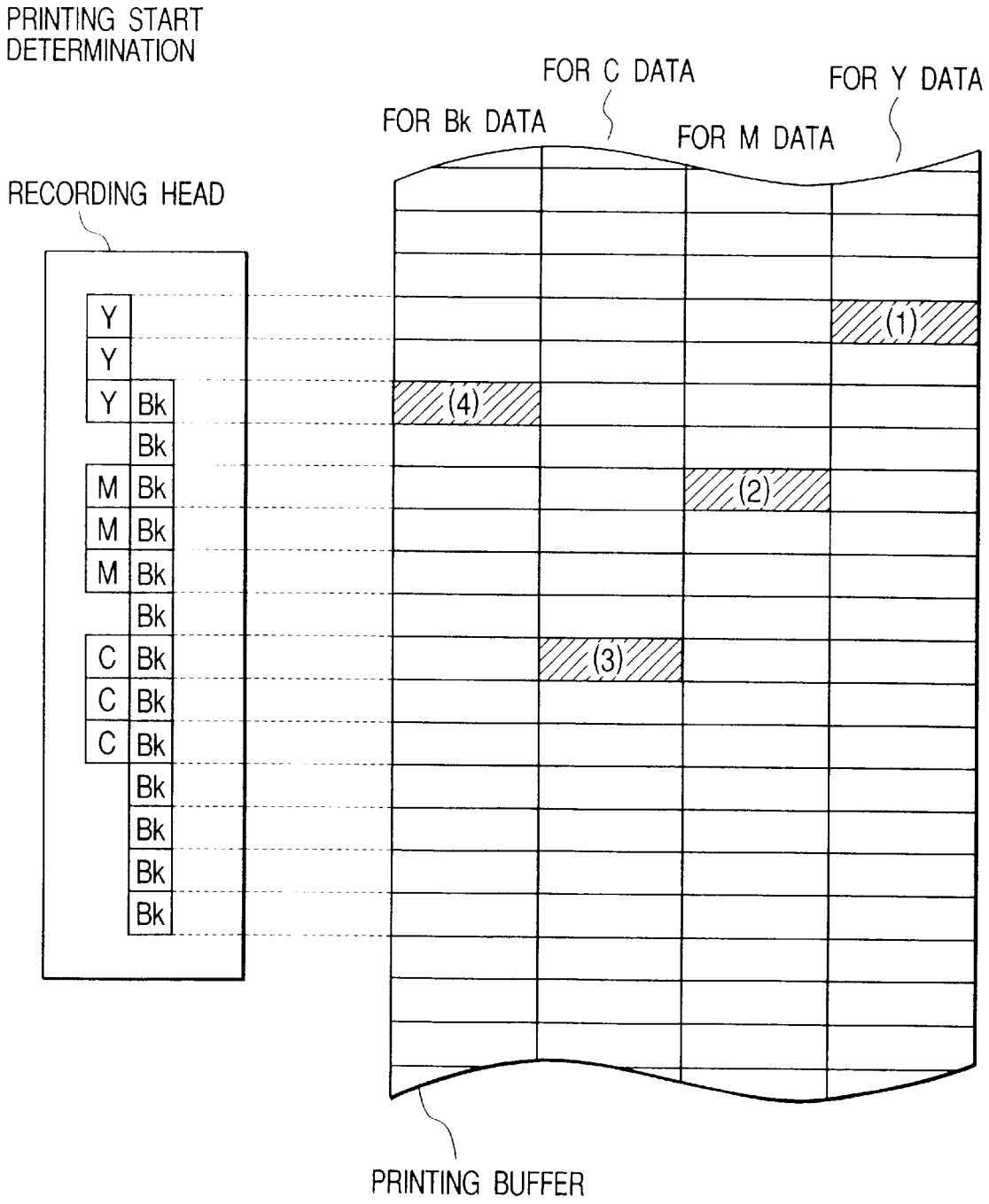
FIG. 17 is a diagram showing the operation of the recording head and determination of print data when the flowchart of FIG. 14 is executed.
Figure 18:
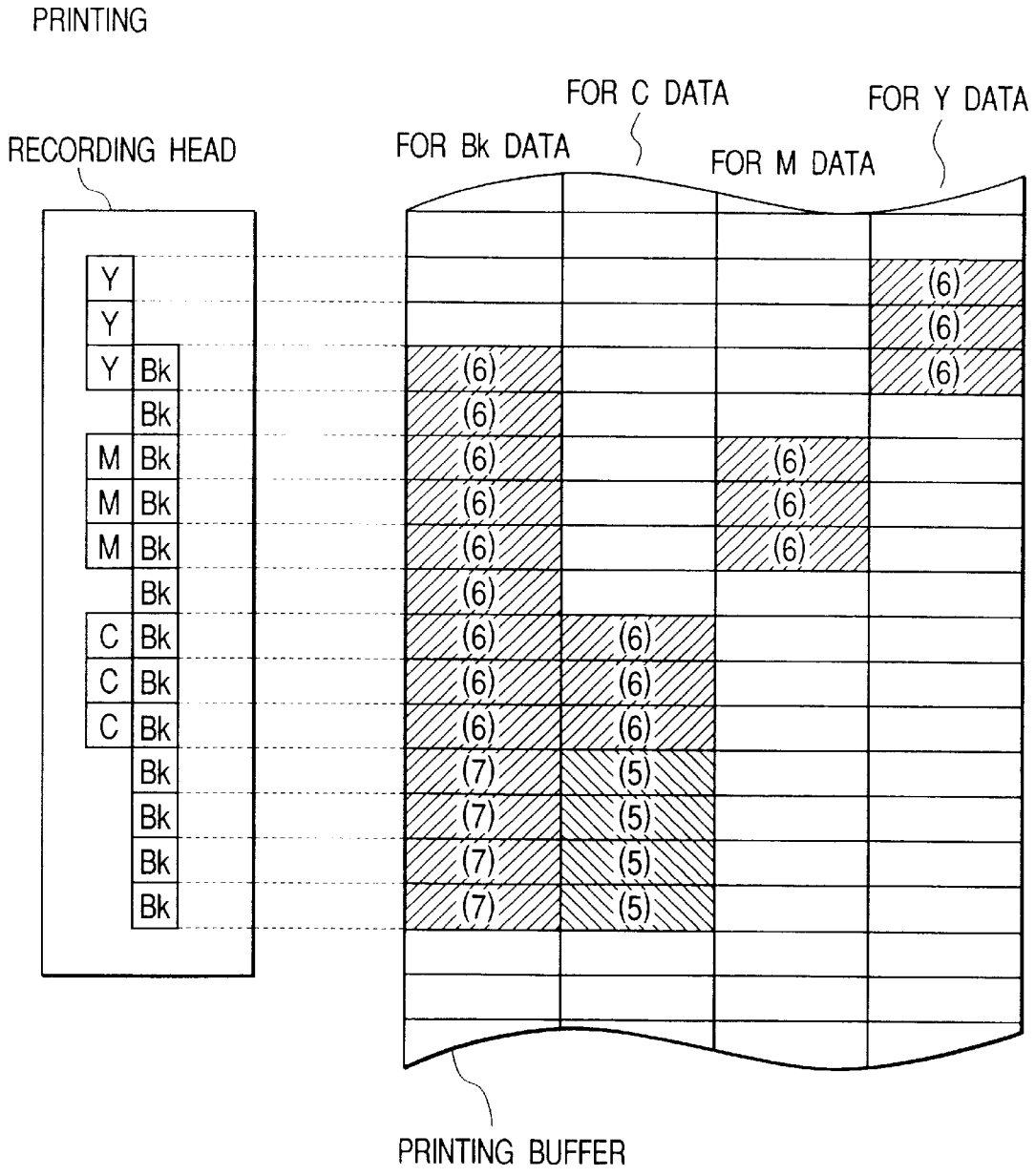
FIG. 18 is a diagram showing the operation of the recording head and determination of print data when the flowchart of FIG. 14 is executed.

FIG. 14 is a flowchart for explaining the recording operation. FIGS. 15 to 18 are diagrams showing the operation of the recording head and determination of print data when the flowchart of FIG. 14 is executed. More specifically, FIG. 15 shows the position of the recording head when the print data is received in step S1 in FIG. 14. FIG. 16 shows the position of the recording head after the sub-scanning is executed in step S2 in FIG. 14. FIG. 17 shows the determination for data in steps S3 to S6 in FIG. 14. FIG. 18 shows the data determination and the printing operation in steps S7 to S9 in FIG. 14. In this instance, explanation will now be made with respect to a case where the recording operation of one page is performed in the 1-pass forward direction recording mode. The 1-pass forward direction recording mode has been described in the first embodiment.

Hereinbelow, it is assumed that a recording area H is set as an area which can be recorded by simultaneously using both of the black ink and the cyan ink in the same main-scanning, and that a recording area G is set as an area which is located in the rear of the recording area H in the moving direction of the recording medium and which can be recorded with the black ink in the same main-scanning but cannot be recorded with the cyan ink. More precisely, the recording area H denotes an area which can be recorded by using the discharging orifices 103A(Bk: 33 to 56) and 103A(C: 1 to 24) shown in FIG. 12 and the recording area G denotes an area which can be recorded by the discharging orifices 103A(Bk: 1 to 32).

The recording operation of the present embodiment will now be described in detail hereinbelow with reference to FIGS. 14 to 18. First in step S1, the print data of eight rasters alone is received and is developed to printing buffers. The printing buffers on the developing destination indicate printing buffers located next to printing buffers corresponding to the discharging orifices 103A(Bk: 1 to 8). In a situation shown in FIG. 15, they are printing buffers shown by W. In step S2, the sub-scanning is executed by an amount corresponding to eight rasters. After the execution, a positional relation of FIG. 16 is obtained.

In step S3, it is determined whether yellow data exists in an area (1) or not. In this instance, the area (1) denotes an area to be recorded by the discharging orifices 103A(Y: 17 to 24). In a situation shown in FIG. 17, it indicates a printing buffer shown by (1). If yellow data exists in the area, step S7 follows. If NO, the processing routine advances to step S4.

In step S4, it is determined whether magenta data exists in an area (2) or not. In this instance, the area (2) denotes an area to be recorded by using the discharging orifices 103A (M: 17 to 24). In the situation shown in FIG. 17, it denotes a printing buffer shown by (2). If magenta data exists in it, step S7 follows. If NO, the processing routine advances to step S5.

In step S5, it is determined whether cyan data exists in an area (3) or not. In this instance, the area (3) denotes an area to be recorded by the discharging orifices 103A(C: 17 to 24). In the situation shown in FIG. 17, it denotes a printing buffer shown by (3). If cyan data exists in it, step S7 follows. If NO, the processing routine advances to step S6.

In step S6, it is determined whether black data exists in an area (4) or not. In this instance, the area (4) denotes an area to be recorded by the discharging orifices 103A(Bk: 97 to 104). In the situation shown in FIG. 17, it denotes a printing buffer shown by the area (4). If black data exists in it, step S7 follows. If NO, the processing routine is returned to step S1.

In step S7, it is determined whether cyan data exists in the area G or not. In a situation shown in FIG. 18, it is determined whether print data exists in the printing buffers shown by an area (5) or not. If cyan data exists in the area, S8 follows. If NO, the processing routine advances to step S9.

In step S8, print data is recorded by using all of the nozzles except the nozzles 103A(Bk: 1 to 32). In the situation shown in FIG. 18, data in the printing buffers shown by (6) is recorded. The data in the printing buffers after the recording is deleted. After that, in step S10, whether the recording operation of one page is finished or not is determined. In this instance, when it is determined that it is not finished, the processing routine is returned to step S1 to repeat the above operation.

In step S9, the print data is recorded by using all of the nozzles. In the situation shown in FIG. 18, data in printing buffers shown by (6) and (7) is recorded. The data in the printing buffers after the recording is deleted. After that, whether the recording of one page is finished or not is determined in step S10. In this instance, when it is determined that it is not finished, the processing routine is returned to step S1 to repeat the above operation.

Figure 19:
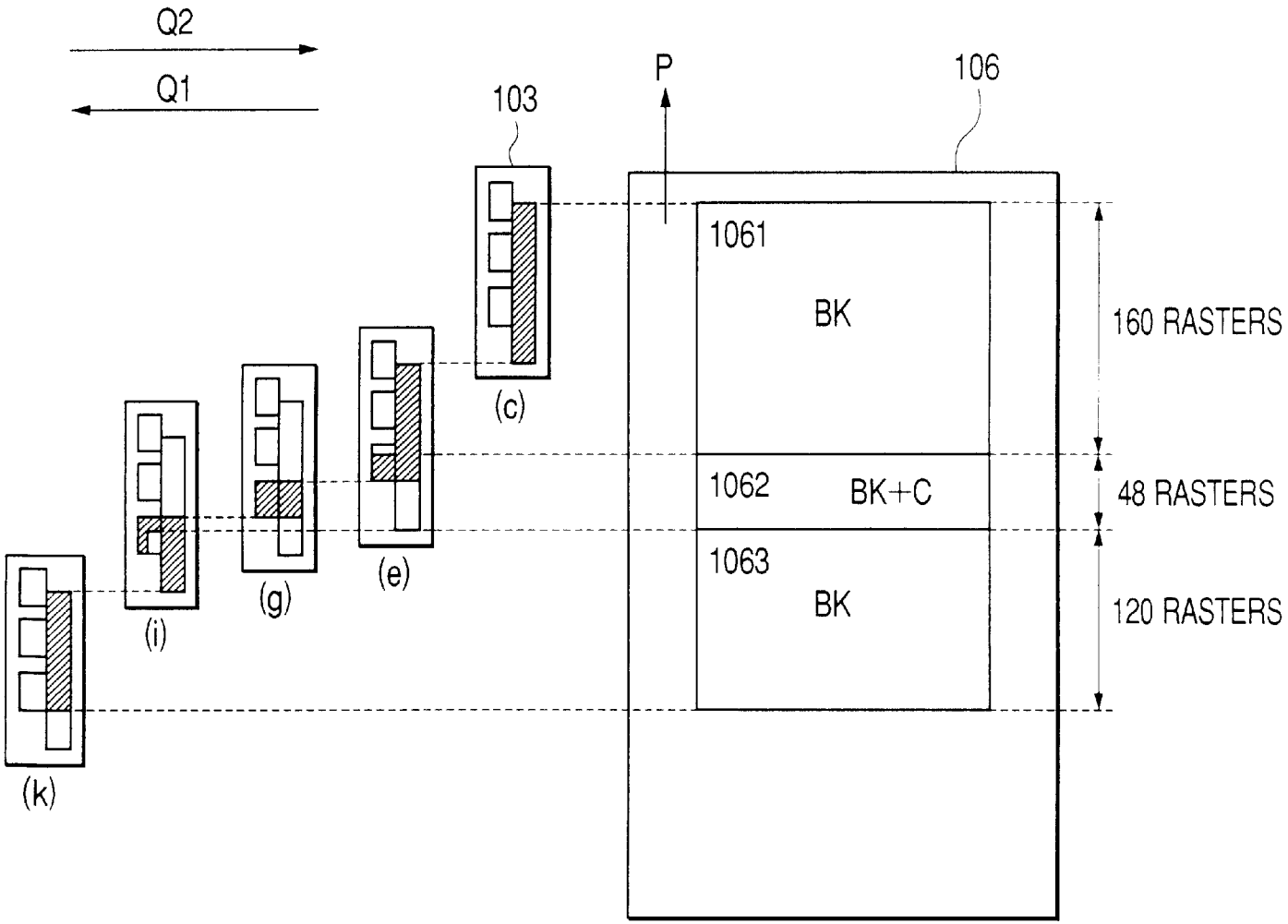
FIG. 19 is an explanatory diagram of the recording operation in the third embodiment of the present invention.

FIG. 19 is a diagram for explaining the recording operation based on the algorithm of the present embodiment. A recording area 1601 in FIG. 19 denotes an area to be recorded with the black ink alone and has a longitudinal width of 160 rasters. A recording area 1602 denotes an area to be recorded with the black ink and the cyan ink as superposed or combined and has a longitudinal width of 48 rasters. A recording area 1603 denotes an area to be recorded with the black ink alone and has a longitudinal width of 120 rasters. FIGS. 20 to 31 are diagrams showing a situation indicative of the presence or absence of data in printing buffers and the position of the recording head.

Figure 20:
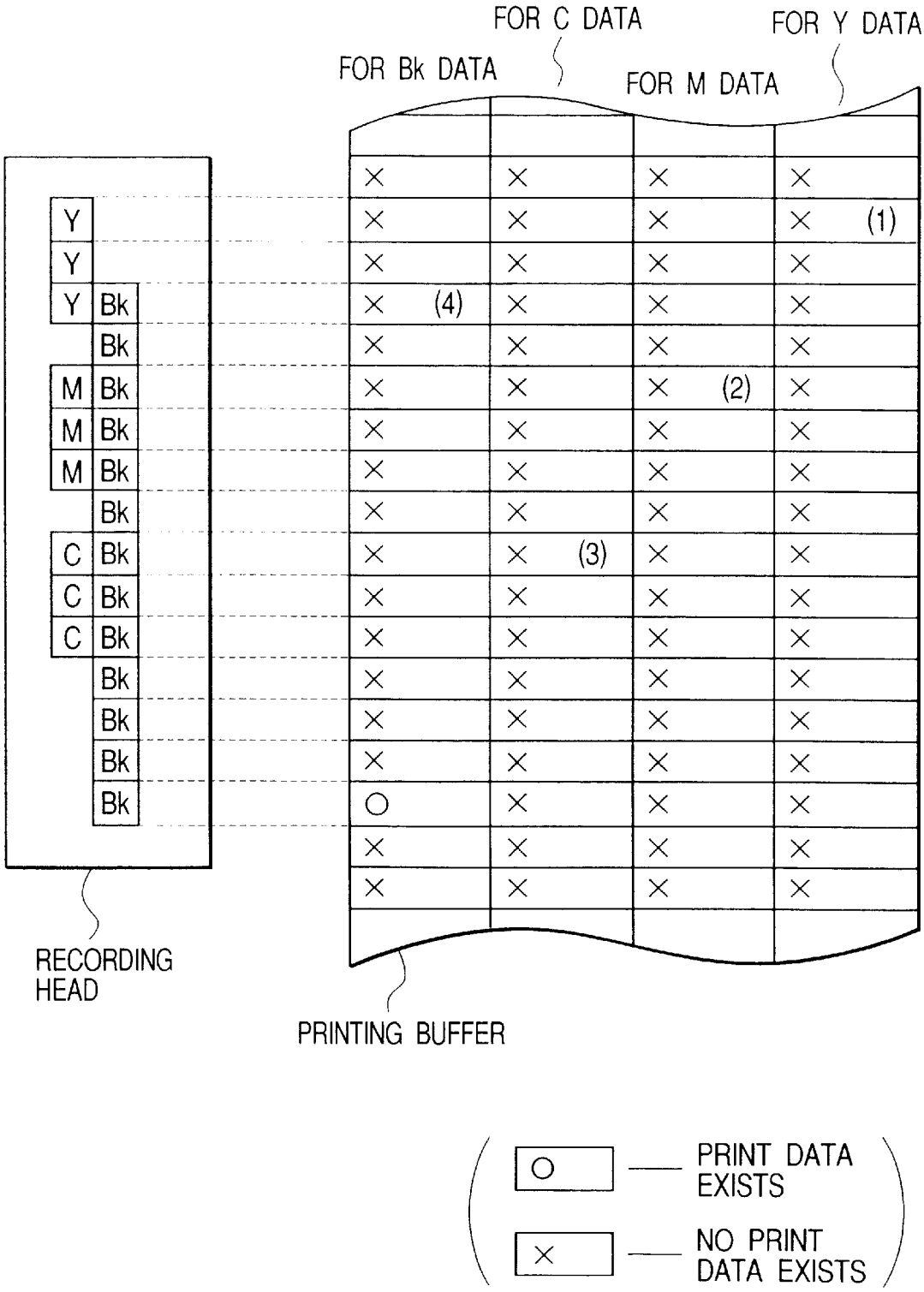
FIG. 20 is a diagram showing a situation indicative of the presence or absence of data in the printing buffer and the position of the recording head.

The recording medium 106 inserted to the paper feeding position of the recording apparatus 100 is conveyed by the feed roller 109 to the head position of the recording area in the direction shown by the arrow P. Subsequently, the process is started in accordance with the algorithm shown in FIG. 14. First in step S1, print data of eight rasters from the first one is received and developed to printing buffers. Next, in step S2, the sub-scanning of an amount corresponding to eight rasters is executed. FIG. 20 shows the relation between the situation indicative of the presence or absence of data in the printing buffers at that time and the position of the recording head at that time. In FIGS. 20 to 31, the presence of print data in the printing buffer is shown by ○ and the absence of print data is shown by ×.

In step S3, it is determined whether yellow data exists in the buffer (1). Since no data exists, the processing routine advances to step S4. In step S4, it is determined whether magenta data exists in the buffer (2) or not. Since no data exists, step S5 follows. In step S5, it is determined whether cyan data exists in the buffer (3) or not. Since no data exists, step S6 follows. In step S6, it is determined whether black data exists in the buffer (4) or not. Since no data exists, the processing routine is returned to step S1.

Figure 21:
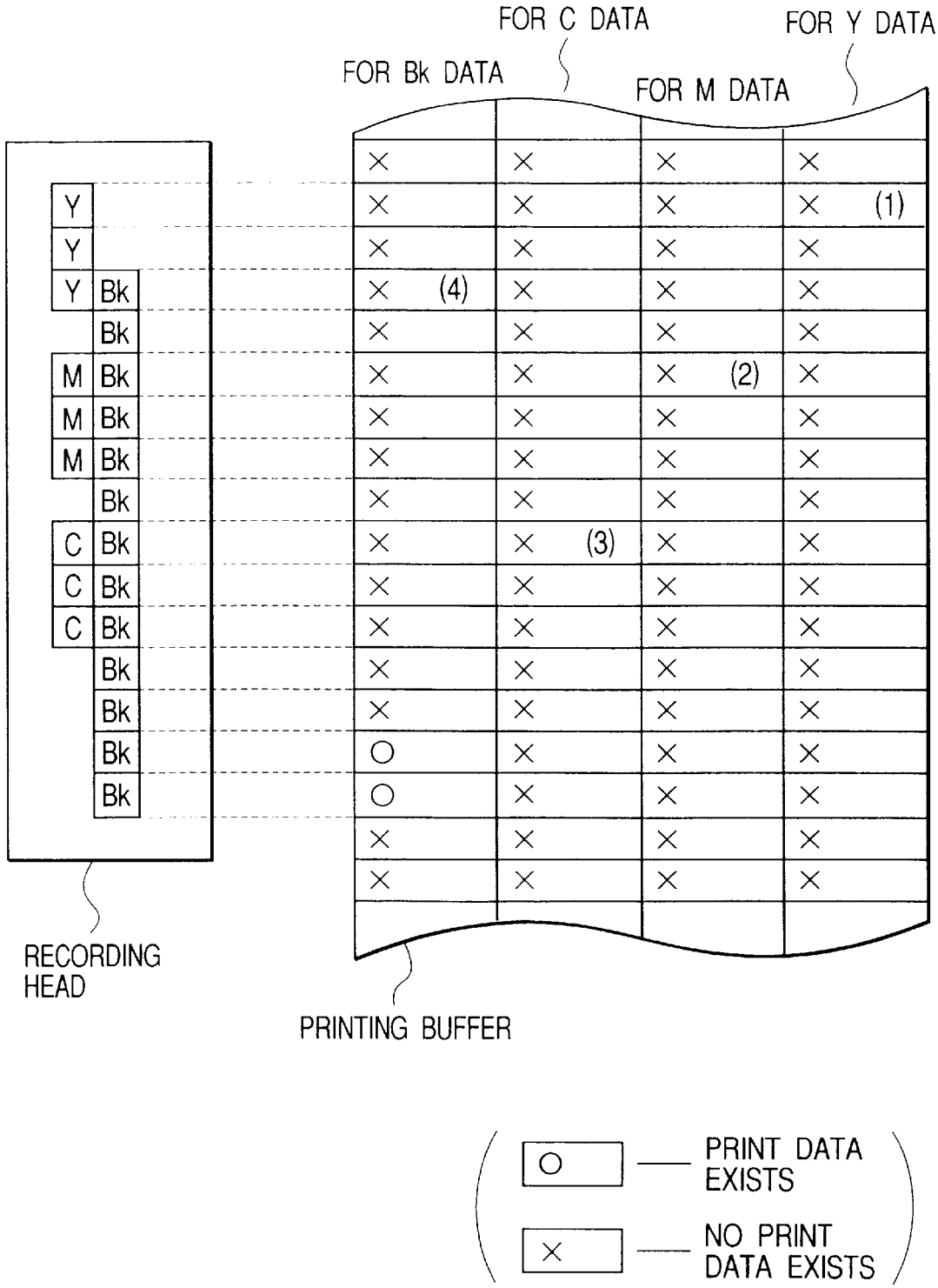
FIG. 21 is a diagram showing a situation indicative of the presence or absence of data in the printing buffer and the position of the recording head.
Figure 22:
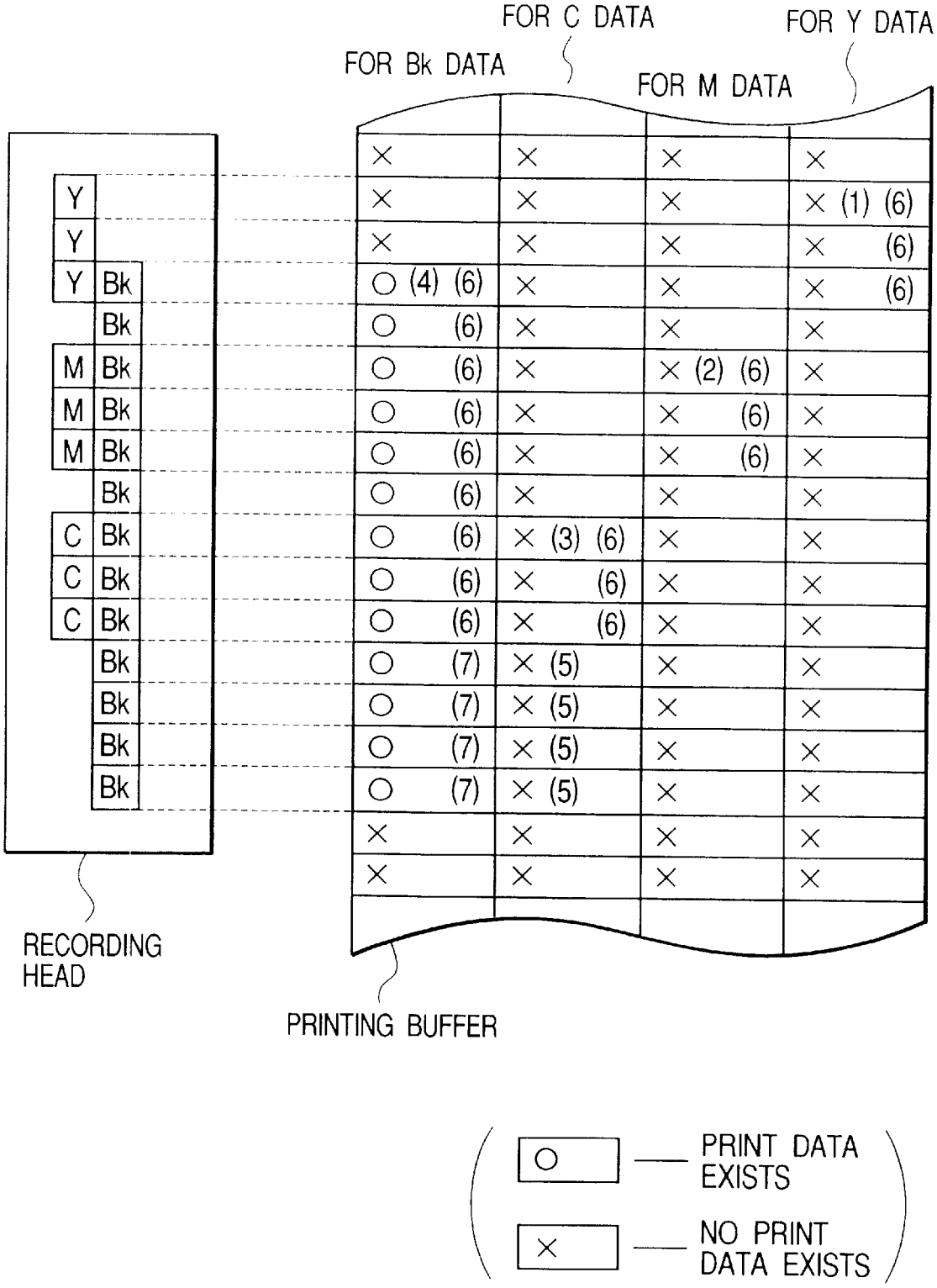
FIG. 22 is a diagram showing a situation indicative of the presence or absence of data in the printing buffer and the position of the recording head.

When the processing routine is returned to step S1, print data of eight rasters from the ninth raster is received and developed to the printing buffers. Subsequently, in step S2, the sub-scanning of an amount corresponding to eight rasters is executed. FIG. 21 shows the relation between the situation indicative of the presence or absence of data in the printing buffers at that time and the position of the recording head at that time.

In step S3, it is determined whether yellow data exists in the buffer (1) or not. Since no data exists, step S4 follows. In step S4, it is determined whether magenta data exists in the buffer (2) or not. Since no data exists, step S5 follows. In step S5, it is determined whether cyan data exists in the buffer (3) or not. Since no data exists, step S6 follows. In step S6, it is determined whether black data exists in the buffer (4) or not. Since no data exists, the processing routine is again returned to step S1.

Since the determinations of S3 to S6 indicate NO until data to 96th raster is received and the process is finished, the process and discrimination of S1→S2→S3→S4→S5→S6→S1 are repeated 12 times, so that the sub-scanning of a total amount corresponding to 96 rasters is executed. The subsequent process will now be described.

First in step S1, print data of eight rasters from the 97th one is received and developed to printing buffers. After that, in step S2, the sub-scanning of an amount corresponding to eight rasters is executed. FIGS. 19(*c*) and 22 show the relation between the situation indicative of the presence or absence of data in the printing buffers at that time and the position of the recording head at that time.

In step S3, it is determined whether yellow data exists in the buffer (1) or not. Since no data exists, the processing routine advances to step S4. In step S4, it is determined whether magenta data exists in the buffer (2) or not. Since no data exists, step S5 follows. In step S5, it is determined whether cyan data exists in the buffer (3) or not. Since no data exists, step S6 follows. In step S6, it is determined whether black data exists in the buffer (4) or not. Since the data exists, step S7 follows. In step S7, it is determined whether cyan data exists in the buffer (5) or not. Since no data exists, step S9 follows.

Figure 23:
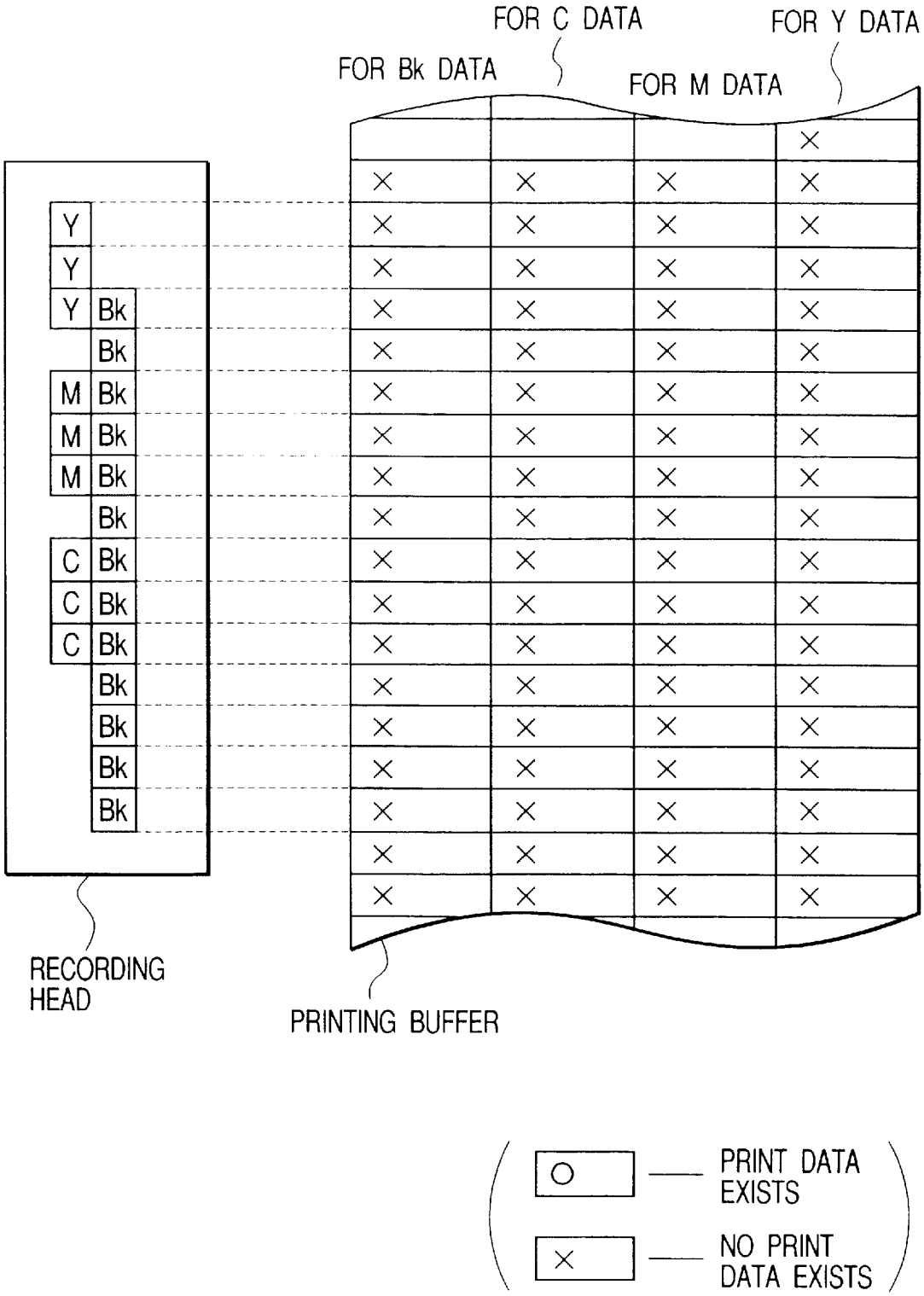
FIG. 23 is a diagram showing a situation indicative of the presence or absence of data in the printing buffer and the position of the recording head.
Figure 24:
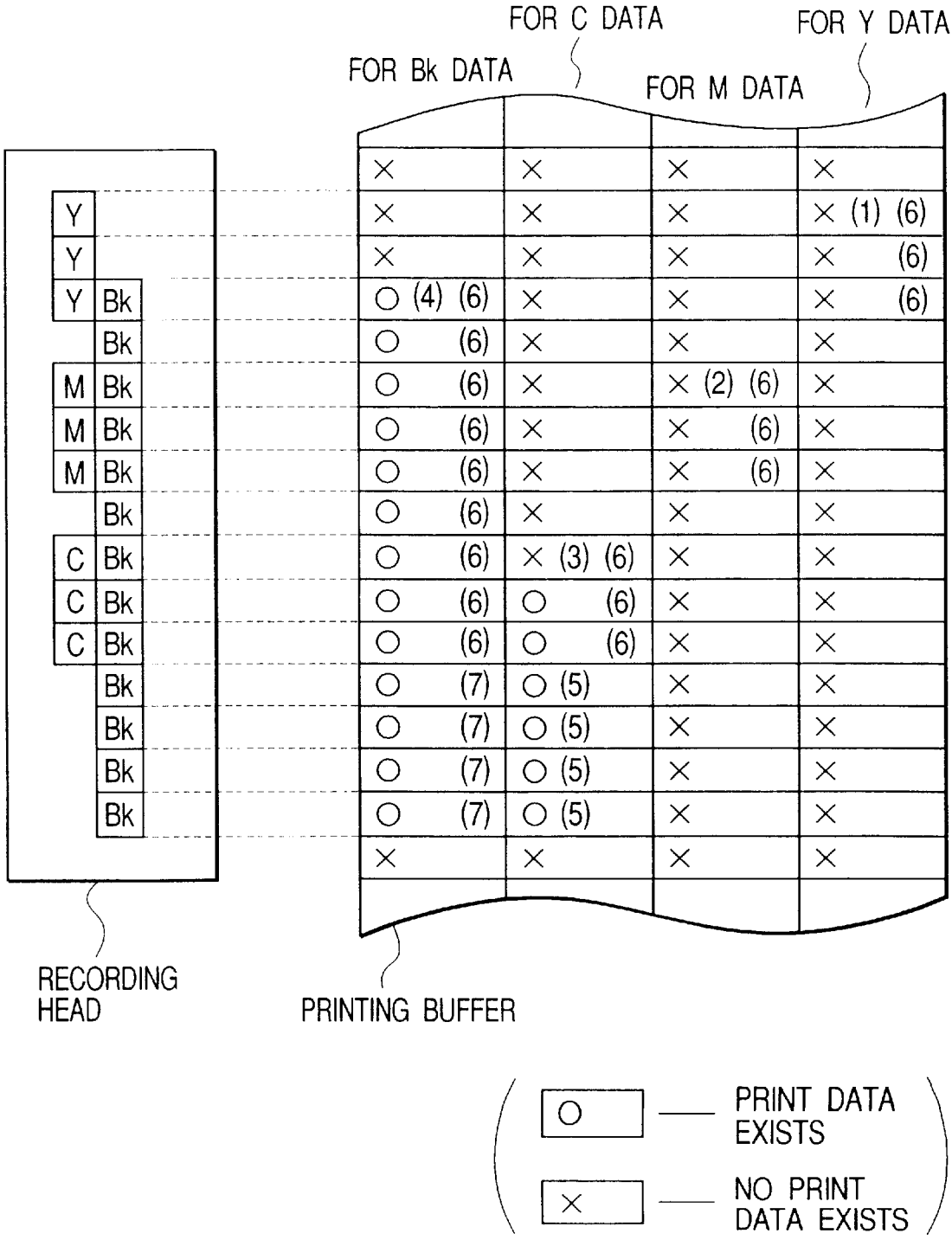
FIG. 24 is a diagram showing a situation indicative of the presence or absence of data in the printing buffer and the position of the recording head.

In step S9, print data in the buffers (6) and (7) is recorded. The data in the printing buffers after the recording is deleted and the processing routine is returned to step S1. FIG. 23 shows the relation between the situation indicative of the presence or absence of data in the printing buffers after the recording and the position of the recording head at that time.

After that, since the determinations of S3 to S6 indicate NO until the data to the 200th raster is received and the process is finished, the process and the determination of S1→S2→S3→S4→S5→S6→S1 are repeated 12 times, so that the sub-scanning of a total amount corresponding to 96 rasters is executed. The following process will now be described.

First in step S1, print data of eight rasters from the 201st raster is received and developed to printing buffers. In step S2, the sub-scanning of an amount corresponding to eight rasters is executed. FIGS. 19(*e*) and 24 show the relation between the situation indicative of the presence or absence of data in the printing buffers at that time and the position of the recording head at that time.

Figure 25:
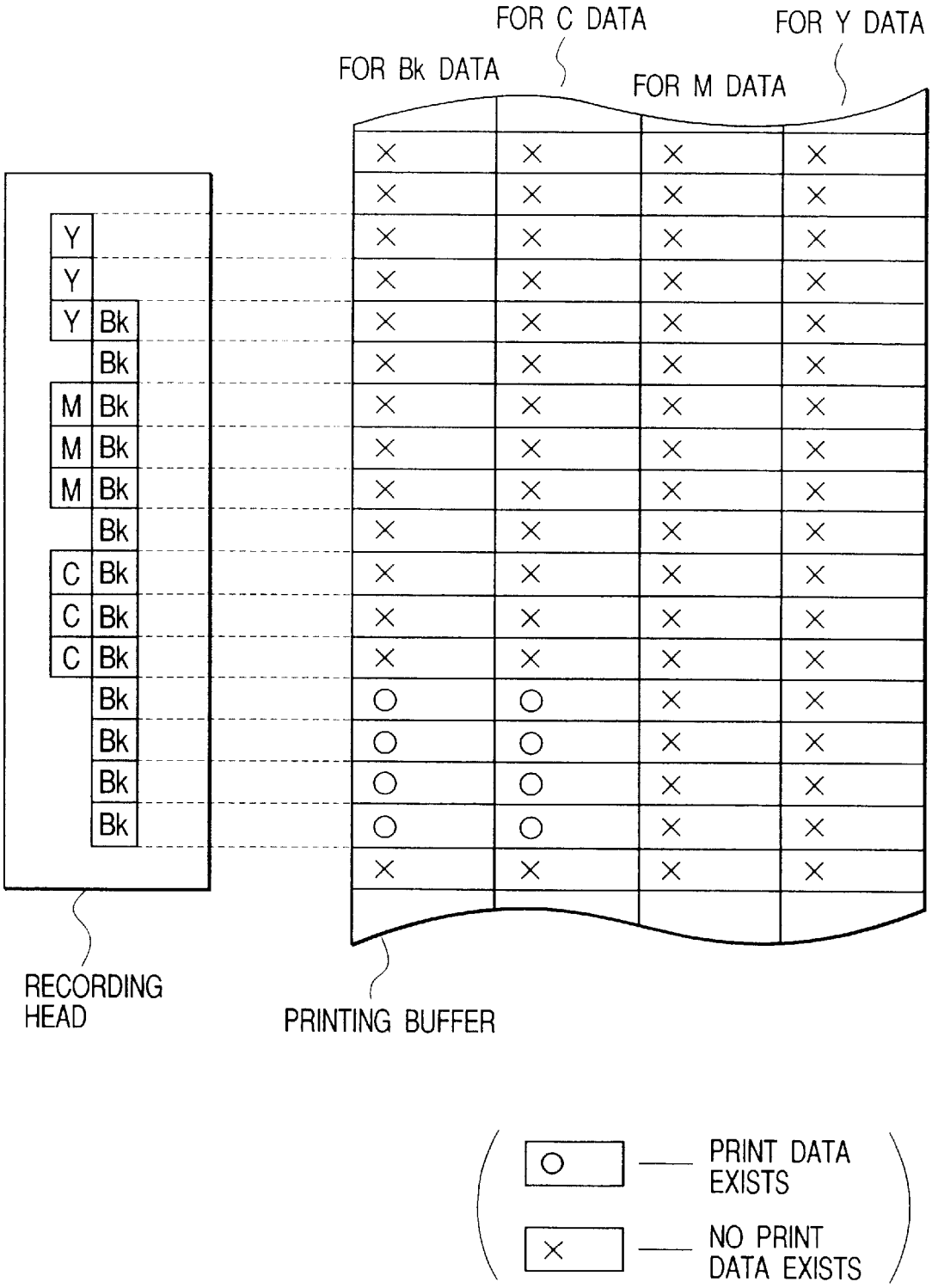
FIG. 25 is a diagram showing a situation indicative of the presence or absence of data in the printing buffer and the position of the recording head.
Figure 26:
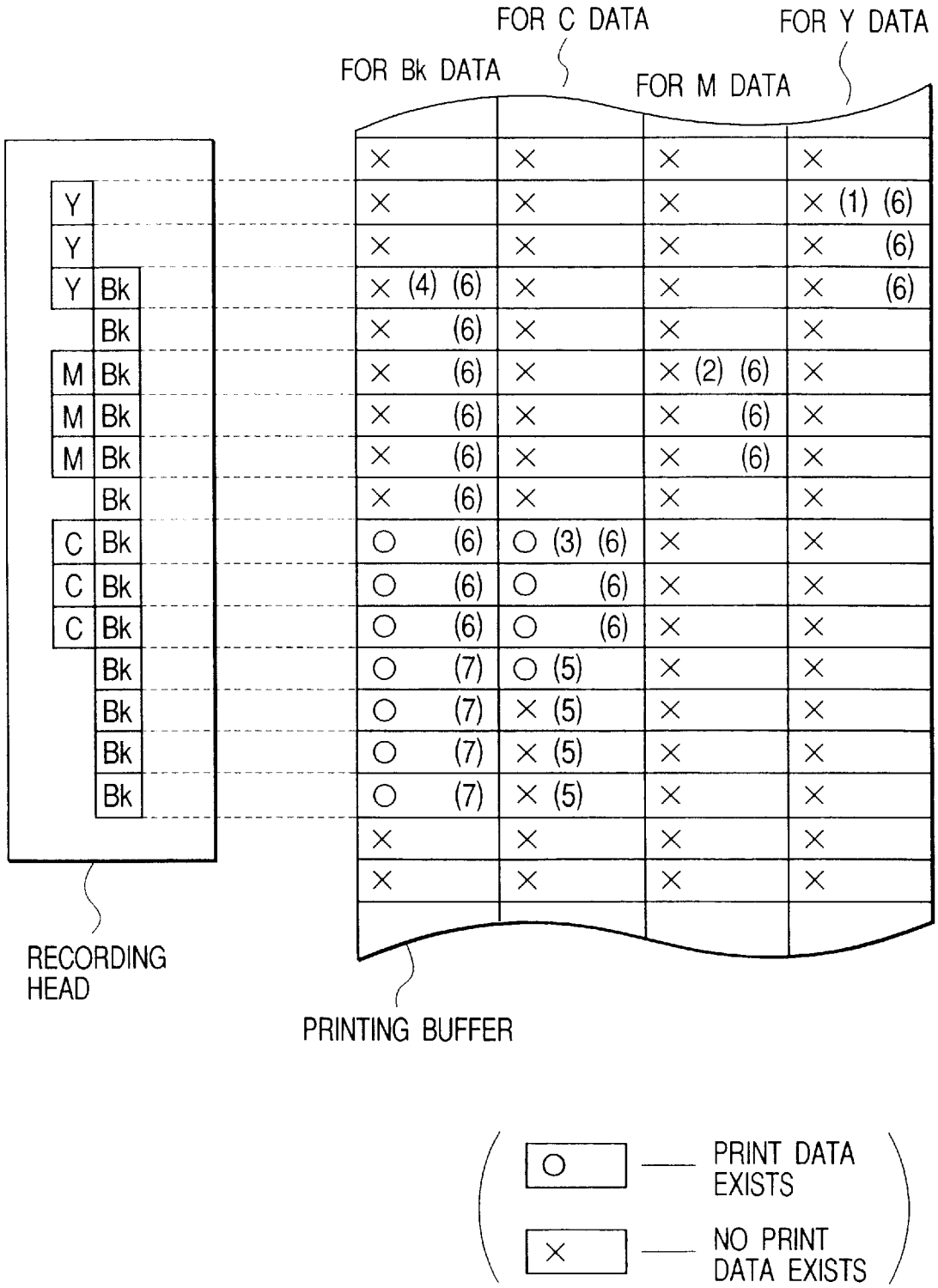
FIG. 26 is a diagram showing a situation indicative of the presence or absence of data in the printing buffer and the position of the recording head.

In step S3, it is determined whether yellow data exists in the buffer (1) or not. Since no data exists, step S4 follows. In step S4, it is determined whether magenta data exists in the buffer (2) or not. Since no data exists, step S5 follows. In step S5, it is determined whether cyan data exists in the buffer (3) or not. Since no data exists, step S6 follows. In step S6, it is determined whether black data exists in the buffer (4) or not. Since the data exists, step S7 follows. In step S7, it is determined whether cyan data exists in the buffer (5) or not. Since the data exists, step S8 follows. In step S8, the print data in the buffers (6) is recorded. The data in the printing buffers after the recording is deleted and the processing routine is returned to step S1. FIG. 25 shows the relation between the situation indicative of the presence or absence of data in the printing buffers after the recording and the position of the recording head at that time.

After that, since the determinations of S3 to S6 indicate NO until data to the 224th raster is received and the process is finished, the process and the determination of S1→S2→S3→S4→S5→S6→S1 are repeated two times, so that the sub-scanning of a total amount corresponding to 16 rasters is executed. The subsequent process will now be described.

First in step S1, print data of eight rasters from the 225th raster is received and developed to printing buffers. In step S2, the sub-scanning of an amount corresponding to eight rasters is executed. FIGS. 19(*g*) and 26 show the relation between the situation indicative of the presence or absence of data in the printing buffers at that time and the position of the recording head at that time.

Figure 27:
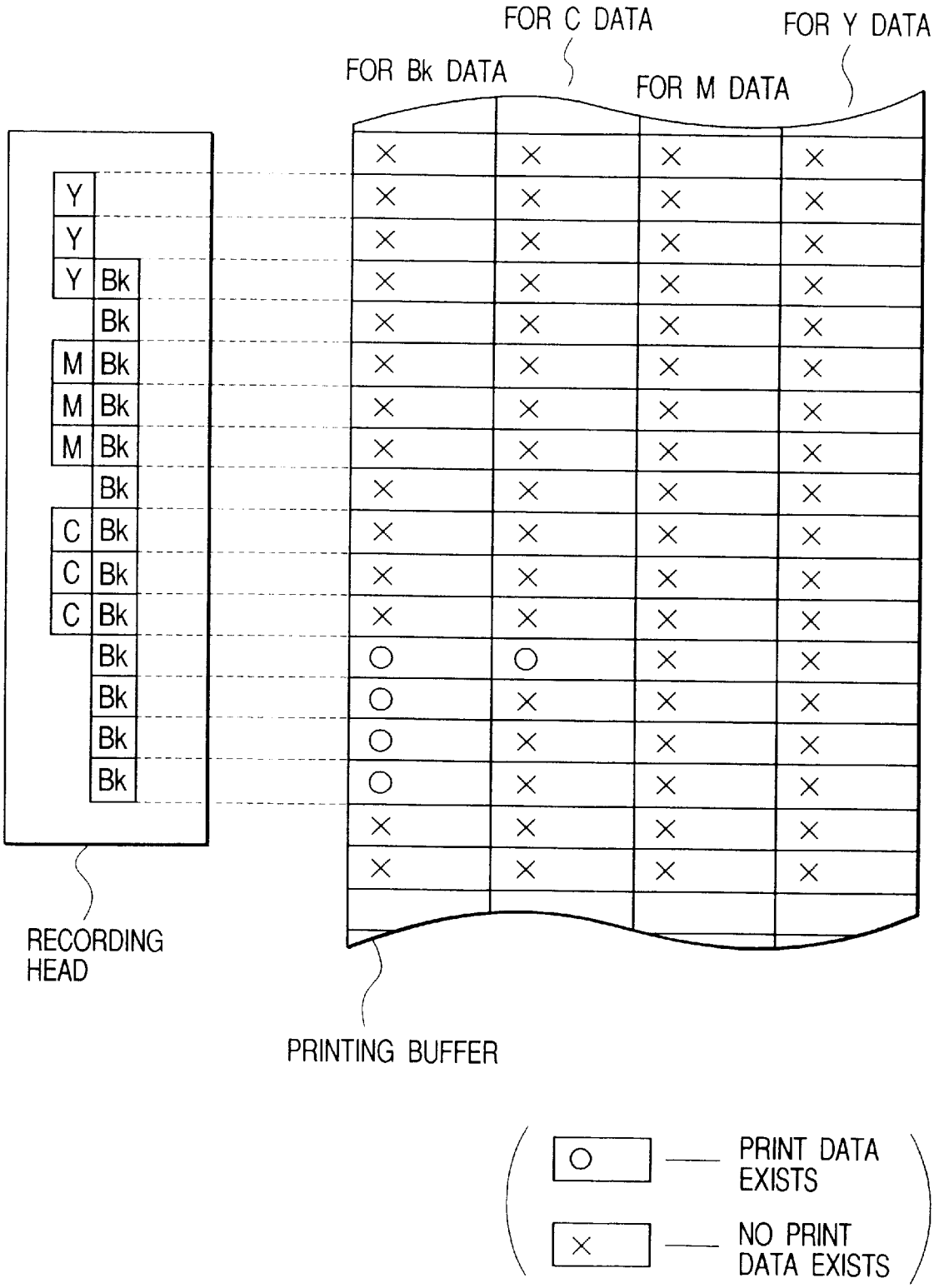
FIG. 27 is a diagram showing a situation indicative of the presence or absence of data in the printing buffer and the position of the recording head.
Figure 28:
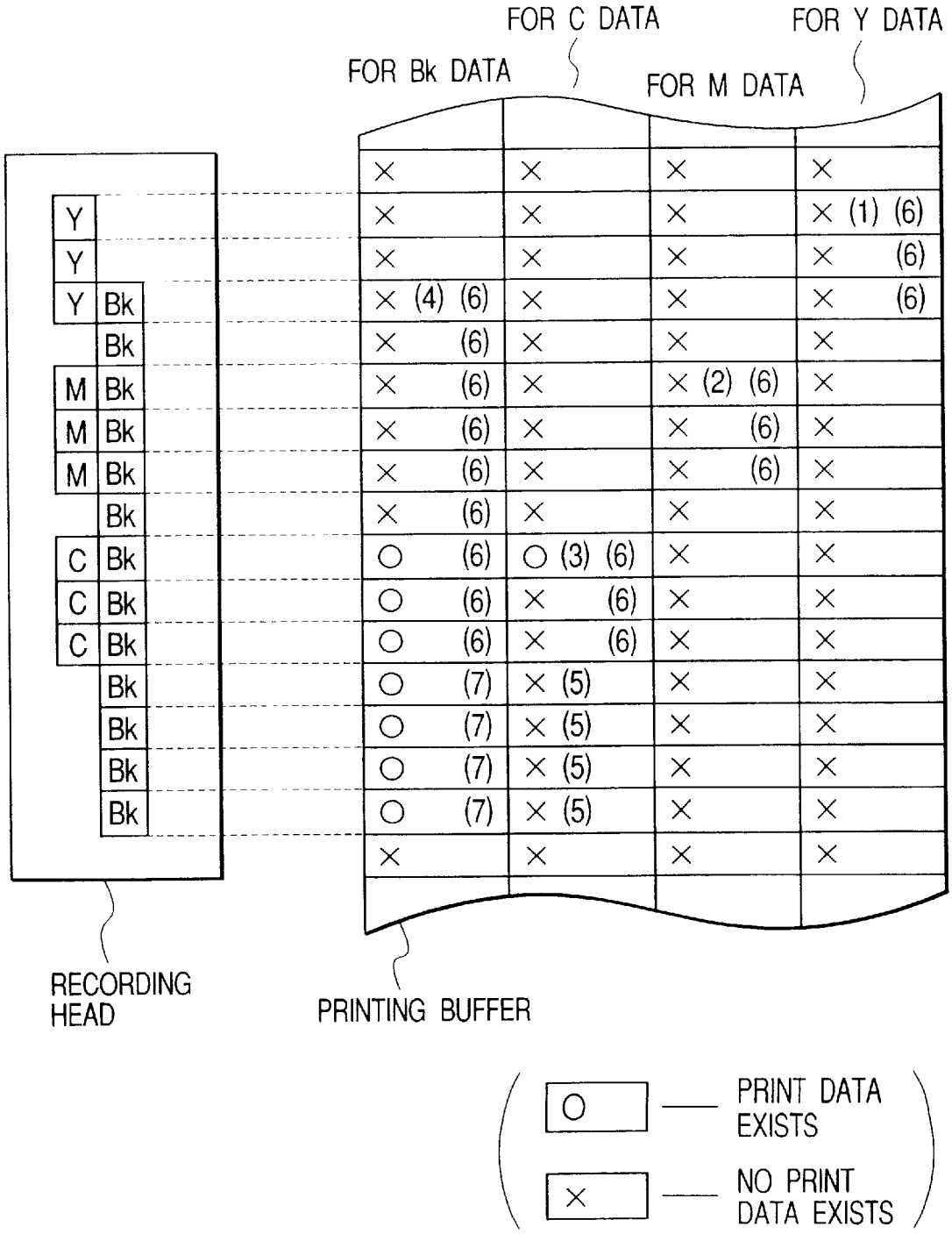
FIG. 28 is a diagram showing a situation indicative of the presence or absence of data in the printing buffer and the position of the recording head.

In step S3, it is determined whether yellow data exists in the buffer (1) or not. Since no data exists, step S4 follows. In step S4, it is determined whether magenta data exists in the buffer (2) or not. Since no data exists, step S5 follows. In step S5, it is determined whether cyan data exists in the buffer (3) or not. Since the data exists, the processing routine advances to step S7. In step S7, it is determined whether cyan data exists in the buffer (5) or not. Since the data exists, step S8 follows. In step S8, the print data in the buffers (6) is recorded. The data in the printing buffers after the recording is deleted and the processing routine is returned to step S1. FIG. 27 shows the relation between the situation indicative of the presence or absence of data in the printing buffers after the recording and the position of the recording head at that time.

After that, since the determinations of S3 to S6 indicate NO until data to the 248th raster is received and the process is finished, the process and the determination of S1→S2→S3→S4→S5→S6→S1 are repeated two times, so that the sub-scanning of a total amount corresponding to 16 rasters is executed. The subsequent process will now be described.

First in step S1, print data of eight rasters from the 249th raster is received and developed to printing buffers. In step S2, the sub-scanning of an amount corresponding to eight rasters is executed. FIGS. 19(*i*) and 28 show the relation between the situation indicative of the presence or absence of data in the printing buffers at that time and the position of the recording head at that time.

In step S3, it is determined whether yellow data exists in the buffer (1) or not. Since no data exists, step S4 follows. In step S4, it is determined whether magenta data exists in the buffer (2) or not. Since no data exists, step S5 follows. In step S5, it is determined whether cyan data exists in the buffer (3) or not. Since the data exists, step S7 follows. In step S7, it is determined whether cyan data exists in the buffer (5) or not. Since no data exists, step S9 follows.

Figure 29:
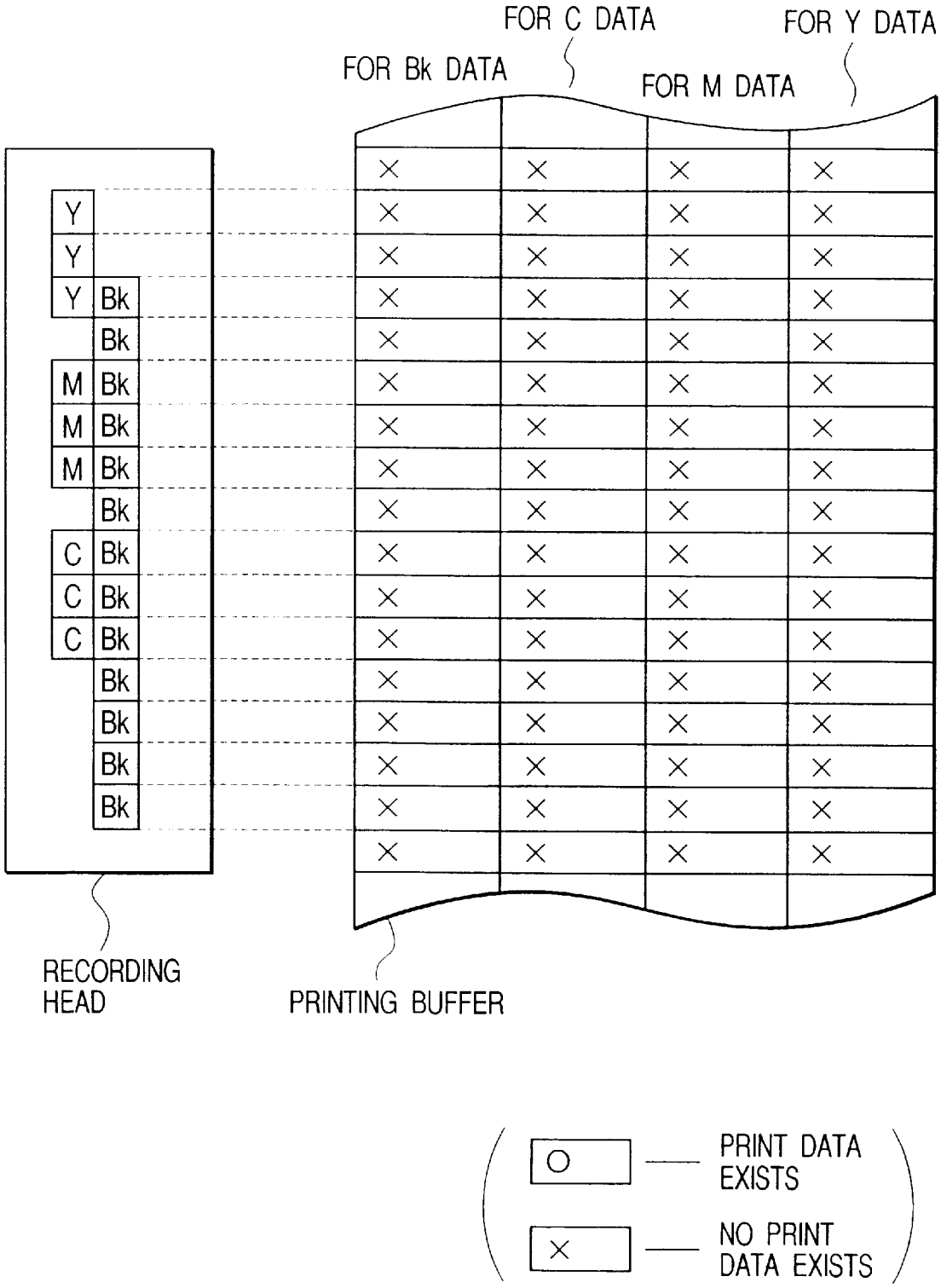
FIG. 29 is a diagram showing a situation indicative of the presence or absence of data in the printing buffer and the position of the recording head.
Figure 30:
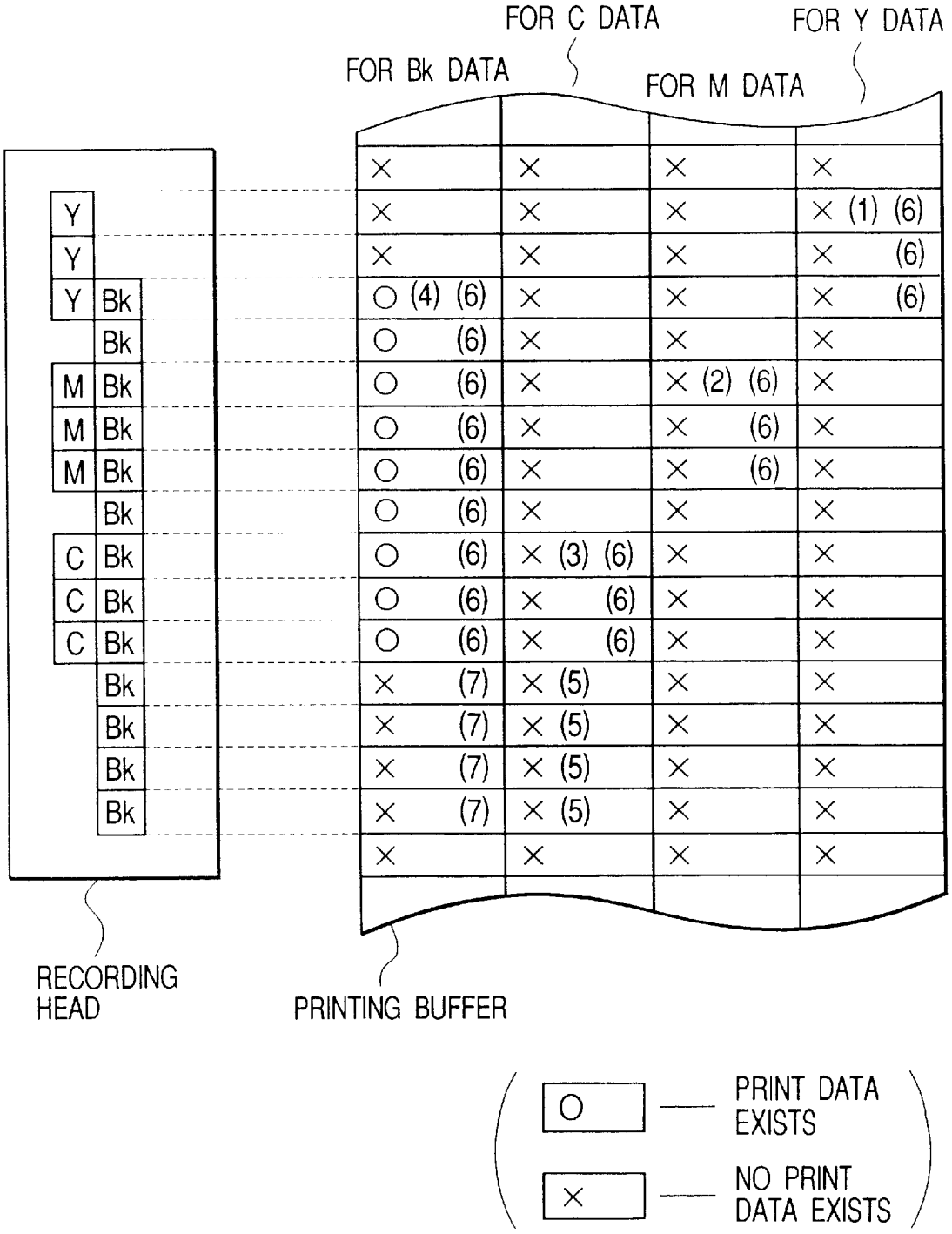
FIG. 30 is a diagram showing a situation indicative of the presence or absence of data in the printing buffer and the position of the recording head.

In step S9, the print data in the buffers (6) and (7) is recorded. The data in the printing buffers after the recording is deleted and the processing routine is returned to step S1. FIG. 29 shows the relation between the situation indicative of the presence or absence of data in the printing buffers after the recording and the position of the recording head at that time.

After that, since the determinations of S3 to S6 indicate NO until the data to the 352nd raster is received and the process is finished, the process and the determination of S1→S2→S3→S4→S5→S6→S1 are repeated 12 times, so that the sub-scanning of a total amount corresponding to 96 rasters is executed. The following process will now be described.

First in step S1, print data of eight rasters from the 353rd raster is received and developed to printing buffers. In step S2, the sub-scanning of an amount corresponding to eight rasters is executed. FIGS. 19(*k*) and 30 show the relation between the situation indicative of the presence or absence of data in the printing buffers at that time and the position of the recording head at that time.

In step S3, it is determined whether yellow data exists in the buffer (1) or not. Since no data exists, step S4 follows. In step S4, it is determined whether magenta data exists in the buffer (2) or not. Since no data exists, step S5 follows. In step S5, it is determined whether cyan data exists in the buffer (3) or not. Since no data exists, step S6 follows. In step S6, it is determined whether black data exists in the buffer (4) or not. Since the data exists, step S7 follows. In step S7, it is determined whether cyan data exists in the buffers (5) or not. Since no data exists, step S9 follows.

Figure 31:
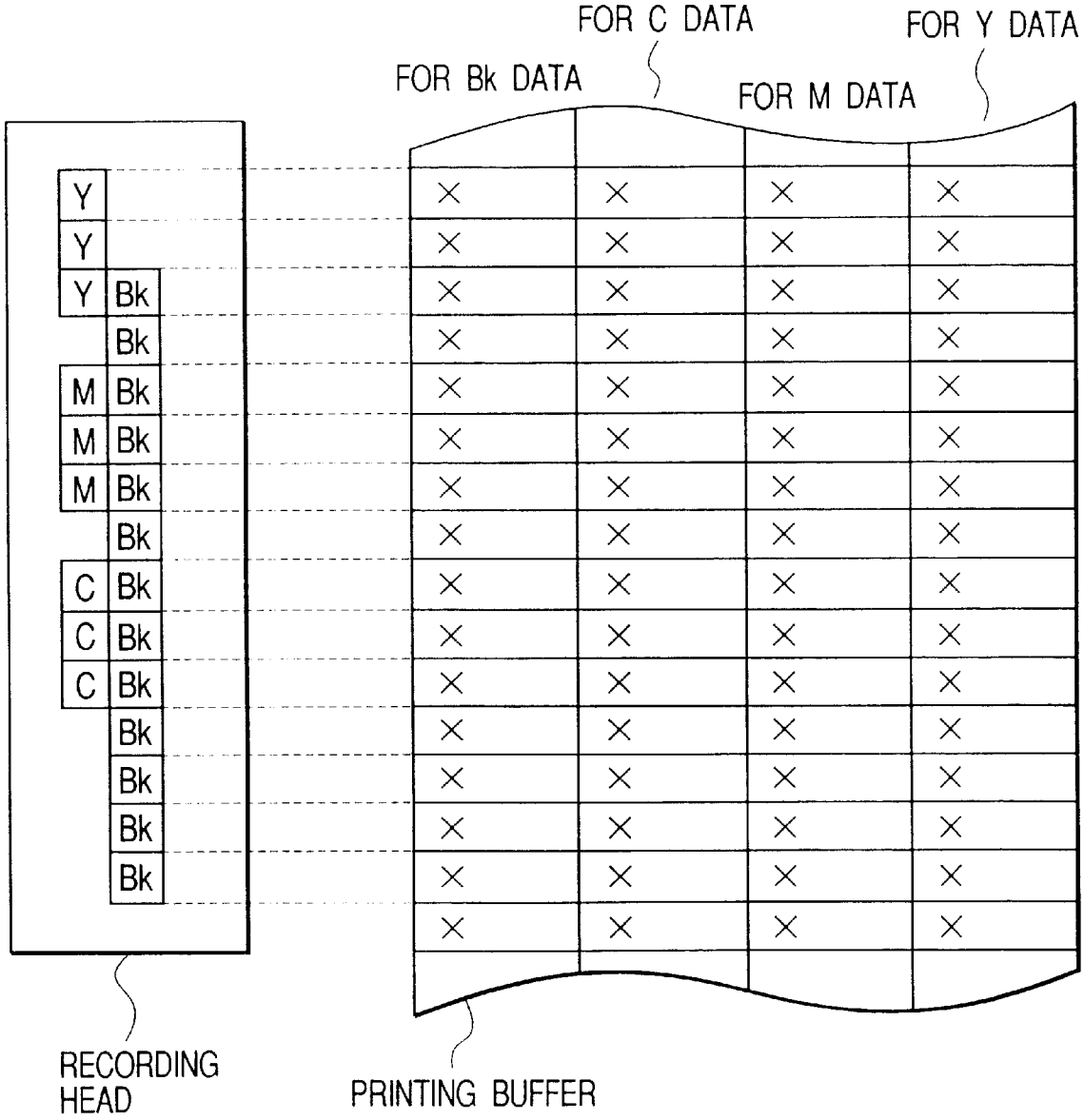
FIG. 31 is a diagram showing a situation indicative of the presence or absence of data in the printing buffer and the position of the recording head.

In step S9, the print data in the buffers (6) and (7) is recorded. The data in the printing buffers after the recording is deleted and the processing routine is returned to step S1. FIG. 31 shows the relation between the situation indicative of the presence or absence of data in the printing buffers after the recording and the position of the recording head at that time. When the recording of all data is completed as mentioned above, the recording medium 106 is ejected and the process is finished.

The above recording operation is executed under the control of the CPU for controlling the whole of the ink jet recording apparatus. More specifically, the CPU 402 reads out the control program to execute the above recording process, which has been stored in the memory unit 403, thereby executing the control.

As mentioned above, in the present embodiment, since the area to be recorded with the two color inks—such as black ink and color ink superposed or combined—is always recorded in the main-scanning, the occurrence of band unevenness can be suppressed. As described above, since the recording medium is conveyed as much as possible in accordance with image data—namely, the maximum sub-scanning amount is assured—the recording operation is performed without reducing a recording speed.

The above recording head is not limited to one of a system for ejecting ink by using electrothermal converting elements. A discharging head of, for example, a piezo system may be used to eject liquid in such a manner that supplying a current to piezo-electric elements vibrates the piezo-electric elements. Another system that may be used as a high-voltage application is an electrostatic attracting system. The electrostatic attracting system has been used in ink jet recording apparatuses.

(Other Embodiment)

According to the embodiments of the present invention, needless to say, the invention can be accomplished in such a manner that a storage medium, in which a program code in software that realizes the functions of the foregoing embodiments has been recorded, is supplied to a system or an apparatus. A computer (or CPU or MPU) of the system or apparatus reads and executes the program code stored in the storage medium.

In this case, the program code itself, which is read from the storage medium, realizes the functions of the foregoing embodiments. The storage medium in which the program codes has been stored constructs the present invention.

As examples, a floppy disk, a hard disk, an optical disk, a magnetooptical disk, a CD-ROM, a CD-R, a magnetic tape, a non-volatile memory card, or a ROM can be used as a storage medium to store the program code.

Furthermore, needless to say, the present invention includes the functions of the above-mentioned embodiments being realized by executing the program code read by the computer. In addition, an OS (operating system) or the like operating in the computer executes a part or the whole of the actual processing on the basis of the instruction of the program code. This permits realizing the functions of the above-mentioned embodiments.

Furthermore, needless to say, the present invention includes the program code read from the storage medium being written into a memory provided for a function extension board inserted in the computer or a function extension unit connected to the computer. Then, the CPU or the like provided for the function extension board or function extension unit executes a part or the whole of the actual processing on the basis of the instruction of the program code. This permits realizing the functions of the foregoing embodiments.

The present invention brings about excellent effects particularly in a recording apparatus with recording heads of the ink jet system utilizing heat energy to record by forming flying liquid droplets, among the ink jet recording systems.

For the typical construction and principle, a system utilizing a fundamental principle disclosed in, for example, U.S. Pat. Nos. 4,723,129 and 4,740,796 is preferable. The system is applicable to both of a so-called on-demand type recording system and a continuous type recording system. Particularly, it is effectively applicable to the on-demand type system for the following reasons. When at least one driving signal which corresponds to recording information and which causes a rapid temperature rise exceeding nucleate boiling is supplied to an electrothermal converting element arranged in correspondence with a sheet or liquid flow path which holds a liquid (ink), the electrothermal converting element is allowed to generate heat energy, thereby producing film boiling on a thermal acting surface of the recording head. Consequently, it is possible to form a bubble in the liquid (ink) in one-to-one correspondence with the driving signal. The liquid (ink) is ejected through a discharging orifice due to the growth and contraction of the bubble, thereby forming at least one droplet. It is more preferable to define the driving signal so as to have a pulse waveform because the growth and contraction of the bubble can be effectuated immediately and, particularly, the liquid (ink) can be ejected with quick response. As a driving signal having the pulse waveform, signals disclosed in U.S. Pat. Nos. 4,463,359 and 4,345,262 are suitable. Further excellent recording can be realized by utilizing conditions in the invention regarding the temperature rising rate on the thermal acting surface, which has been disclosed in U.S. Pat. No. 4,313,124.

In addition to the structure (a linear liquid flow path or a right-angle liquid flow path) which is a combination of discharging orifices, liquid flow paths, and electrothermal converting elements disclosed in the above-mentioned specifications, the structure disclosed in U.S. Pat. Nos. 4,558,333 and 4,459,600, in which a thermal acting portion is arranged in a flexed area, may be used as a structure of the recording head.

In addition, the recording head can be constructed on the basis of Japanese Patent Laid-Open Publication No. 59-123670 disclosing a structure in which a common slit is used as an ejecting portion for a plurality of thermal converting elements or Japanese Patent Laid-Open Publication No. 59-138461 disclosing a structure in which an opening for absorbing a pressure wave of heat energy is formed so as to correspond to the ejecting portion.

Further, the present invention is applicable to a recording head which is fixed to the apparatus main body, a replaceable chip type recording head which can be electrically connected to the apparatus main body and to which ink can be supplied when it is mounted on the apparatus main body, or a cartridge type recording head in which an ink tank is integrally provided for the recording head itself.

As for the structure of the recording apparatus of the present invention, it is preferable to add ejection recovery means, preliminarily auxiliary means, and the like for the recording head because they can further stabilize the effects of the present invention. Specifically speaking, the means include capping means, cleaning means, pressing or suction means for the recording head, preliminary heating means for heating by using an electrothermal converting element or a heating element other than the above element or combination thereof, and preliminary discharging means for discharging separately from the recording.

As for the kind and number of recording heads to be mounted, two or more heads corresponding to a plurality of inks having different recording colors or densities may be used. That is, the present invention is effectively applicable to an apparatus having at least one recording mode of a main color mode with black or the like alone, a multi-color mode with different colors, and a full-color mode using the mixture of colors, which may have an integrally formed recording head or a combination of a plurality of recording heads.

Further, in the embodiments of the present invention as mentioned above, the ink has been described as a liquid. The ink is solidified at the room temperature or less. The present invention may also use an ink which is softened or liquefied at the room temperature. Alternatively, since it is general in the ink jet system to perform a temperature control in such a manner that the temperature of the ink itself is adjusted in a range of 30° C. to 70° C. so that the ink viscosity is set within a stable ejection range, the present invention may also use an ink which is liquefied when a use recording signal is supplied.

In addition, because a temperature rise caused by heat energy may be positively prevented by using the temperature rise as energy for a change in state from a solid state to a liquid state of the ink or because evaporation of the ink may be prevented, an ink which is solidified in an unused state and is liquefied by heating may be used. In any case, the present invention is also applicable to the case of using an ink having a nature of being liquefied only by the application of heat energy such as ink which is ejected as a liquid ink after the ink is liquefied by applying heat energy in accordance with recording signals or ink which begins to be solidified when it reaches a recording medium. In this case, an ink may be held in a liquid or solid state in recess portions or through-holes of a porous sheet as described in Japanese Patent Laid-Open Publication No. 54-56847 or 60-71260, and the porous sheet may be arranged so as to face electrothermal converting elements. In the present invention, the above-mentioned film boiling system is most effective for the above-described inks.

Figure 9:
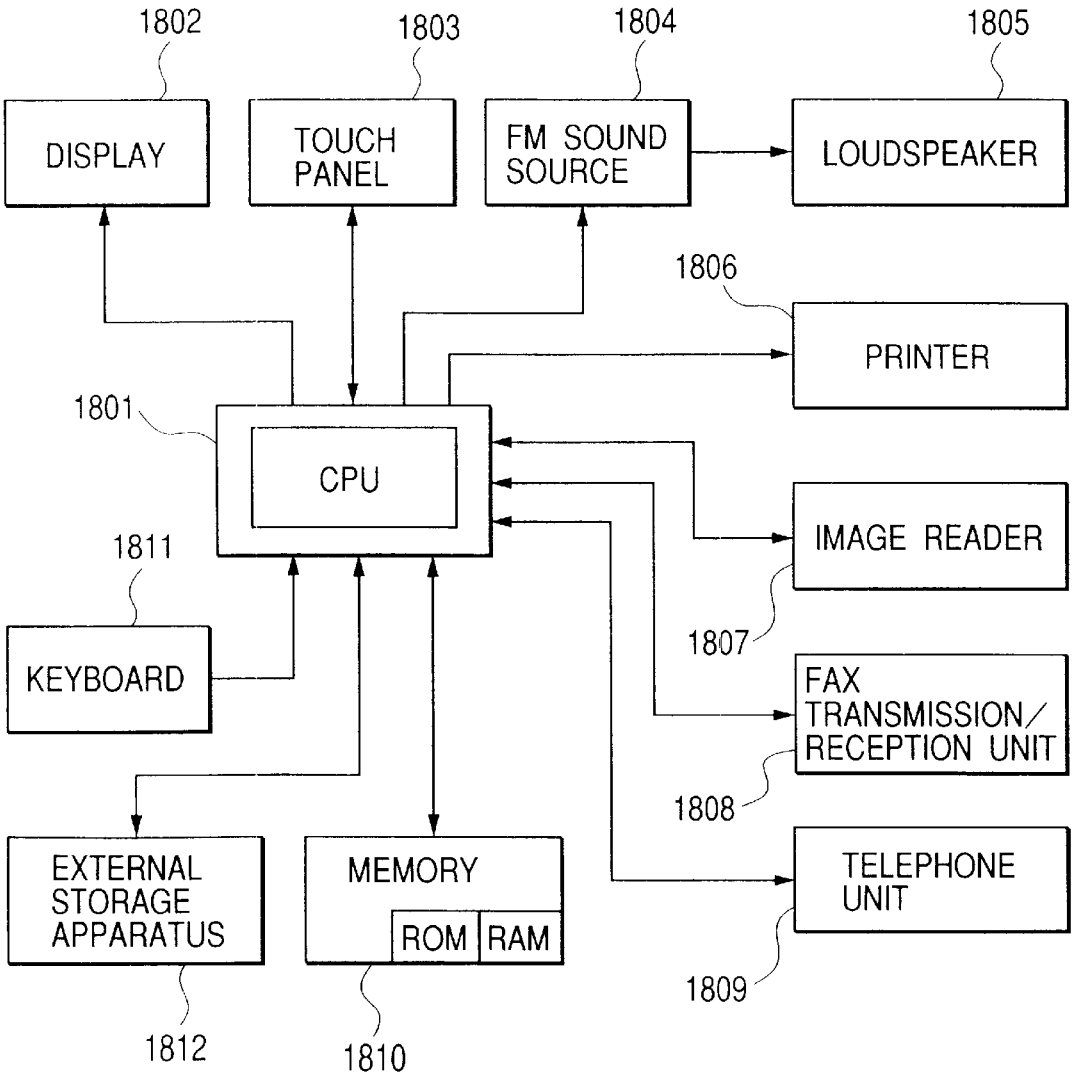
FIG. 9 is a block diagram showing an example of an information processing system using a recording apparatus to which the present invention can be applied.

FIG. 9 is a block diagram showing a schematic construction of a system in which the recording apparatus of the present invention is applied to an information processing apparatus having functions of a word processor, a personal computer, a facsimile apparatus, and a copying machine.

In FIG. 9, a control unit 1801 controls the whole apparatus and has a CPU such as a microprocessor and various I/O ports. The control unit 1801 performs the control operation by generating and receiving a control signal or data signal to/from respective units. A display unit 1802 displays various menus, document information, image data read by an image reader 1807 on its display screen. A transparent touch panel 1803 of a pressure-sensitive type is arranged on the display unit 1802. When the user depresses the surface of the touch panel 1803 with his finger, he can input items, coordinate positions, and the like on the display unit 1802.

An FM (Frequency Modulation) sound source unit 1804 stores music information formed by a music editor or the like into a memory unit 1810 or an external storage apparatus 1812 as digital data, reads out the digital data from the memory unit and the like, and FM-modulates the read-out data. Electrical signals from the FM sound source unit 1804 are converted into audible tones by a loudspeaker unit 1805. A printer unit 1806 is an output terminal of the word processor, personal computer, facsimile apparatus, and copying machine, to which the recording apparatus of the present invention is applied.

The image reader unit 1807 photoelectrically reads and inputs original data and is arranged along an original convey path. The image reader 1807 reads various originals such as facsimile-transmitting original, copying original, and the like. A facsimile (FAX) transmitting/receiving unit 1808 facsimile-transmits the original data read by the image reader 1807 and receives and decodes a transmitted facsimile signal. The transmitting/receiving unit has an interface function with external equipment. A telephone unit 1809 has various telephone functions such as usual telephone function, automatic answering function, and the like.

The memory unit 1810 includes an ROM for storing a system program, a manager program, other application programs, character fonts, and dictionaries. The memory unit 1810 stores an application program and character information loaded from the external storage apparatus 1812. The memory unit 1810 also includes a video RAM and the like.

A keyboard unit 1811 is used for inputting document information and various commands.

The external storage apparatus 1812 has a storage medium such as floppy disk or hard disk. The external storage apparatus 1812 stores document information, music or voice information, and user's application program.

Figure 10:
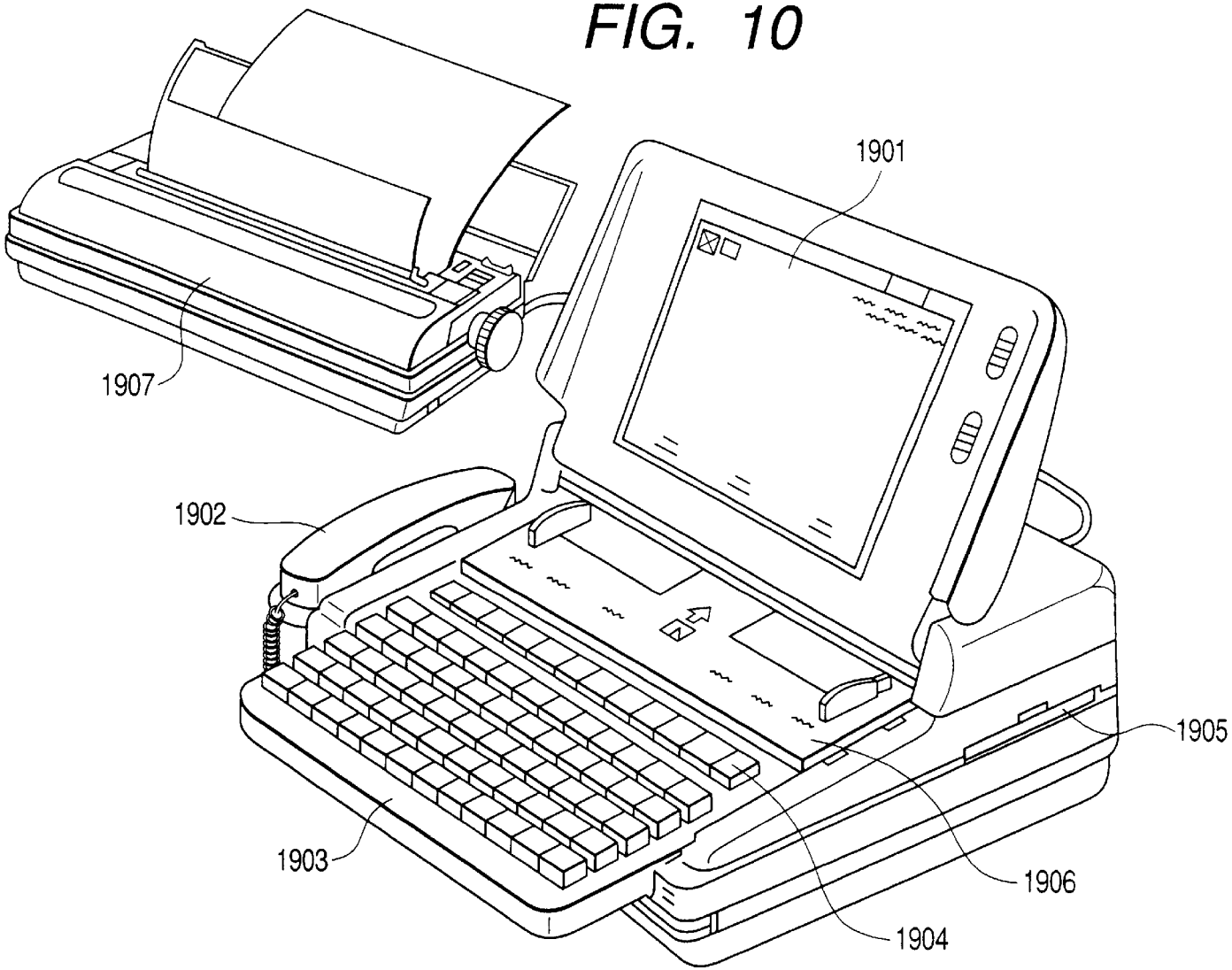
FIG. 10 is an external perspective view of the above system.

FIG. 10 is a schematic external view of the information processing apparatus shown in FIG. 9.

Referring to FIG. 10, a flat panel display 1901, which utilizes liquid crystal or the like, displays various menus, figure information, and document information. When the user depresses the surface of the touch panel 1803 on the display 1901 with his finger, he can input coordinates and item designation. A handset 1902 is used when this apparatus is used as a telephone unit. A keyboard 1903 is detachably connected to the main body through a cord and can be used for inputting various document information and various data. The keyboard has various function keys 1904. An insertion slot 1905 receives a floppy disk for the external storage apparatus 1812.

A paper mounting portion 1906 mounts an original to be read by the image reader unit 1807. The read original is ejected from the rear portion of the apparatus. Upon facsimile reception, an ink jet printer 1907 records information.

Although the display unit 1802 may comprise a CRT in the above description, a flat panel display such as a liquid crystal display utilizing ferroelectric liquid crystal is preferable because a compact, low-profile, and lightweight structure can be realized.

When the above information processing apparatus functions as a personal computer or word processor, various information inputted by the keyboard unit 1811 is processed by the control unit 1801 in accordance with a predetermined program and the resultant data is outputted as an image to the printer unit 1806.

When it functions as a receiver of the facsimile apparatus, facsimile information inputted from the FAX transmitting/receiving unit 1808 through a communication line is received and processed by the control unit 1801 in accordance with a predetermined program and the resultant data is outputted as a received image to the printer unit 1806.

When the information processing apparatus functions as a copying machine, an original is read by the image reader unit 1807 and read original data is outputted as a copied image to the printer unit 1806 through the control unit 1801. When it functions as a receiver of the facsimile apparatus, original data read by the image reader unit 1807 is transmitted and processed by the control unit 1801 in accordance with a predetermined program. After that, the resultant data is transmitted to the communication line through the FAX transmitting/receiving unit 1808.

Figure 11:
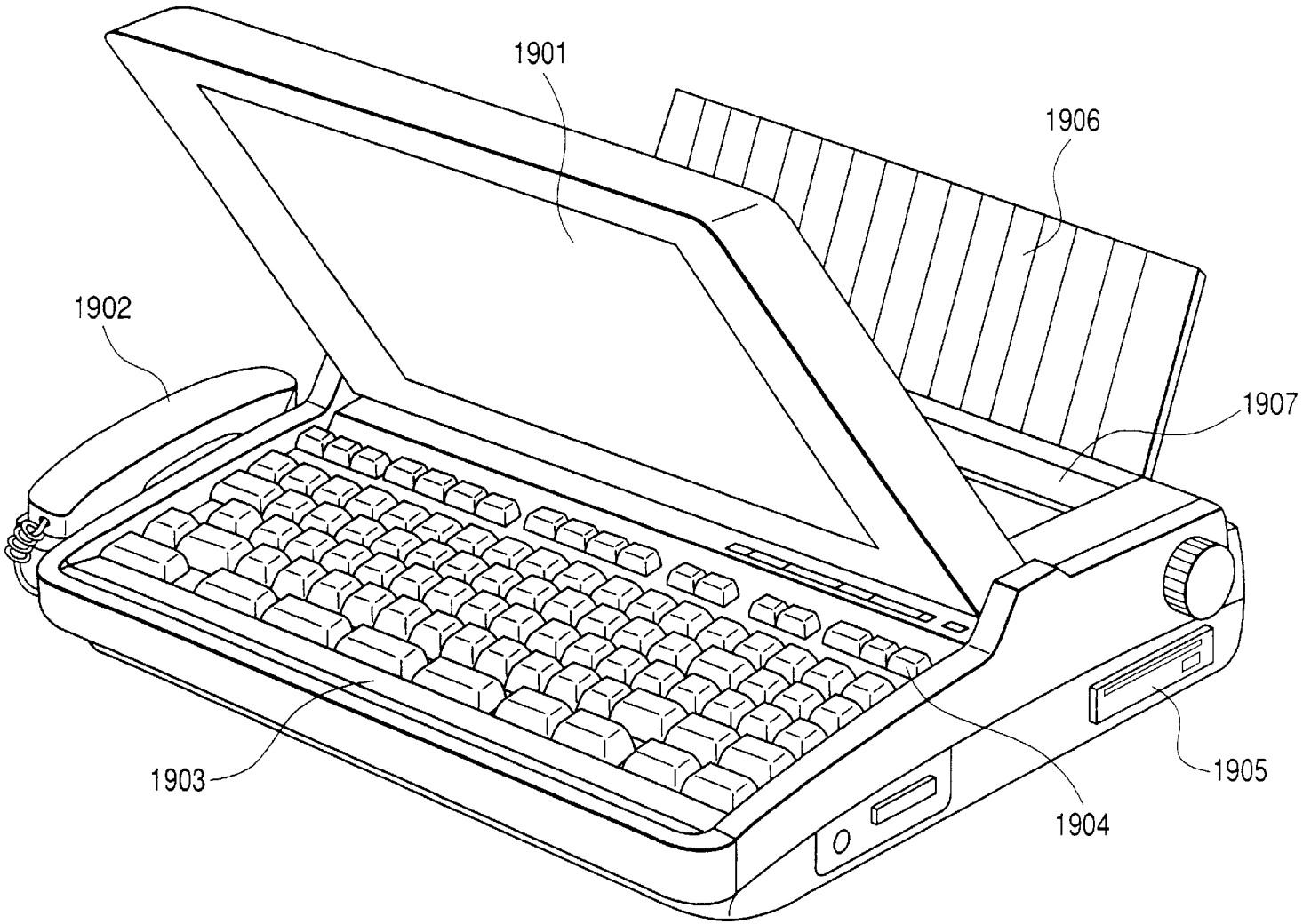
FIG. 11 is an external view showing another example of the system.

The above-mentioned information processing apparatus may be constructed as an integrated type one in which an ink jet printer is built in the main body as shown in FIG. 11. In this case, portability can be further improved. In FIG. 11, component elements having the same functions as those in FIG. 10 are shown by the same reference numerals.

When the recording apparatus of the present invention is applied to the above-described multi-functional information processing apparatus, a high-quality recorded image can be obtained at a high speed with low noises, so that the functions of the above information processing apparatus can be further improved.

As mentioned above, according to the present invention, it is possible to provide an ink jet recording apparatus wherein even when a color image and a black image mixedly exist in a recording area, a color ink and a black ink are recorded in the same main-scanning, thereby enabling to suppress the occurrence of band unevenness without reducing a recording speed.

The present invention is not limited to the above embodiments and various changes and modifications can be made within the spirit and scope of the present invention. Therefore, to apprise the public of the scope of the present invention the following claims are made.

What is claimed is:

1. An ink jet recording apparatus for recording an image on a recording medium, wherein a first discharging orifice array arranging a plurality of discharging orifices for discharging a first ink and a second discharging orifice array arranging a plurality of discharging orifices for discharging a second ink are disposed in parallel in a main-scanning direction different from the arranging direction of the orifice arrays, and said first discharging orifice array, said second discharging orifice array, and the recording medium are relatively moved in the arranging direction of said discharging orifices for each main-scanning of said first discharging orifice array and said second discharging orifice array in the main-scanning direction, said apparatus comprising:

control means for controlling in such a manner that when an area where a main-scanning region of the first discharging orifice array does not overlap with a main-scanning region of the second discharging orifice array is a first area and an overlapping area is a second area, in the case where both of first image data to be recorded by the first discharging orifice array and second image data to be recorded by the second discharging orifice array exist in the first area, recording for the first area by the first discharging orifice array is not performed in the main-scanning but recording is performed by the first and second discharging orifice arrays in the main-scanning after the relative movement is performed up to a position where both the first and second image data can be recorded in the first area, and in the case where the first image data to be recorded by the first discharging orifice array exists in the first area and no second image data to be recorded by the second discharging orifice array exists, in the main-scanning, recording is performed in the first area by the first discharging orifice array.

2. A recording apparatus according to claim 1, wherein the number of discharging orifices of said first discharging orifice array is greater than that of said second discharging orifice array.

3. A recording apparatus according to claim 2, wherein the first ink is a black ink and the second ink is a color ink.

4. A recording apparatus according to claim 3, wherein the color ink is yellow, magenta, or cyan ink.

5. A recording apparatus according to claim 2, wherein there are further provided a third discharging orifice array arranging a plurality of discharging orifices for discharging a third ink and a fourth discharging orifice array arranging a plurality of discharging orifices for discharging a fourth ink, and the number of discharging orifices of each of said third and fourth discharging orifice arrays is equal to that of said second discharging orifice array and the third and fourth discharging orifice arrays are arranged in parallel in said main-scanning direction.

6. A recording apparatus according to claim 5, wherein when image data to be recorded by said second, third, or fourth discharging orifice array exists in the first area, recording by said first discharging orifice array is not performed in the first area, and when no image data to be recorded by the second, third, or fourth discharging orifice array exists in the first area, recording is performed in the first area by the first discharging orifice array.

7. A recording apparatus according to claim 5, wherein the first ink is a black ink and the second, third, and fourth inks are color inks.

8. A recording apparatus according to claim 2, wherein there are further provided a third discharging orifice array arranging a plurality of discharging orifices for discharging a third ink and a fourth discharging orifice array arranging a plurality of discharging orifices for discharging a fourth ink, and the number of discharging orifices of each of said third and fourth discharging orifice arrays is equal to that of said second discharging orifice array and the second, third, and fourth discharging orifice arrays are aligned in the arranging direction of said discharging orifices.

9. A recording apparatus according to claim 8, wherein the first ink is a black ink and the second, third, and fourth inks are color inks.

10. A recording apparatus according to claim 9, wherein the color inks are yellow, magenta, and cyan inks.

11. A recording apparatus according to claim 1, wherein a heat energy generating element for supplying heat energy to ink is provided in each said discharging orifice to cause a change in state of the ink due to heat, thereby allowing the ink to be ejected from the discharging orifice on the basis of the change in state.

12. An ink jet recording method of recording an image on a recording medium, wherein a first discharging orifice array arranging a plurality of discharging orifices for discharging a first ink and a second discharging orifice array arranging a plurality of discharging orifices for discharging a second ink are disposed in parallel in a main-scanning direction different from the arranging direction of the orifice arrays, and said first discharging orifice array, said second discharging orifice array, and the recording medium are relatively moved in the arranging direction of said discharging orifices for each main-scanning of the first discharging orifice array and the second discharging orifice array in the main-scanning direction, said method comprising the step of:

recording in such a manner that when in one main-scanning an area where a main-scanning region of the first discharging orifice array does not overlap with a main-scanning region of the second discharging orifice array is a first area and an overlapping area is a second area, in the case where recording by the first discharging orifice array and recording by the second discharging orifice array are performed in the first area, the recording by the first discharging orifice array and the recording by the second discharging orifice array are performed in the same main-scanning.

13. A storage medium readable by a computer, which has stored a program code to execute a recording control process of an ink jet recording apparatus for recording an image on a recording medium, wherein a first discharging orifice array arranging a plurality of discharging orifices for discharging a first ink and a second discharging orifice array arranging a plurality of discharging orifices for discharging a second ink are disposed in parallel in a main-scanning direction different from the arranging direction of the orifice arrays, and said first discharging orifice array, said second discharging orifice array, and the recording medium are relatively moved in the arranging direction of said discharging orifices for each main-scanning of the first discharging orifice array and the second discharging orifice array in the main-scanning direction, said program code including:

a first control processing code to control the ink jet recording apparatus in such a manner that when in one main-scanning an area where a main-scanning region of the first discharging orifice array does not overlap with a main-scanning region of the second discharging orifice array is a first area and an overlapping area is a second area, in the case where both of first image data to be recorded by the first discharging orifice array and second image data to be recorded by the second discharging orifice array exist in the first area, recording for the first area by the first discharging orifice array is not performed in the main-scanning but recording is performed by the first and second discharging orifice arrays in the main-scanning after the relative movement is performed up to a position where both the first and second image data can be recorded in the first area; and a second control processing code to control the ink jet recording apparatus in such a manner that in the case where the first image data to be recorded by the first discharging orifice array exists in the first area and no second image data to be recorded by the second discharging orifice array exists, recording for the first area is performed in the main-scanning by the first discharging orifice array.

* * * * *

UNITED STATES PATENT AND TRADEMARK OFFICE

CERTIFICATE OF CORRECTION

PATENT NO. : 6,474,775 B1
DATED : November 5, 2002
INVENTOR(S) : Okamoto

It is certified that error appears in the above-identified patent and that said Letters Patent is hereby corrected as shown below:

Column 6,
Line 52, "which" should read -- which, --.

Signed and Sealed this

First Day of July, 2003

JAMES E. ROGAN
*Director of the United States Patent and Trademark Office*